US006457958B1

(12) United States Patent
Dunn

(10) Patent No.: US 6,457,958 B1
(45) **Date of Patent: *Oct. 1, 2002**

(54) SELF COMPENSATING ADJUSTABLE FIT PROGRESSING CAVITY PUMP FOR OIL-WELL APPLICATIONS WITH VARYING TEMPERATURES

(75) Inventor: Lonnie Dunn, Sherwood Park (CA)

(73) Assignee: Weatherford/Lamb, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/818,059

(22) Filed: Mar. 27, 2001

(51) Int. Cl.[7] ..... F04C 2/107; F04C 5/00
(52) U.S. Cl. ..... 418/1; 418/48; 418/107
(58) Field of Search ..... 418/1, 48, 107, 418/153

(56) References Cited

U.S. PATENT DOCUMENTS

| | | | | | |
|---|---|---|---|---|---|
| 2,085,115 | A | * | 6/1937 | Moineau | 418/48 |
| 2,512,764 | A | | 6/1950 | Byram | 418/48 |
| 2,612,845 | A | | 10/1952 | Byram et al. | 418/48 |
| 2,733,854 | A | * | 2/1956 | Chang | 418/48 |
| 2,957,427 | A | * | 10/1960 | O'Connor | 418/48 |
| 4,187,061 | A | | 2/1980 | Jurgens | 418/48 |
| 4,415,316 | A | | 11/1983 | Jurgens | 418/48 |
| 4,676,725 | A | | 6/1987 | Eppink | 418/48 |
| 5,120,204 | A | | 6/1992 | Mathewson et al. | 418/48 |
| 5,145,343 | A | | 9/1992 | Belcher | 418/48 |
| 5,171,138 | A | | 12/1992 | Forrest | 418/48 |
| 5,358,390 | A | | 10/1994 | Jager | 418/48 |
| 5,722,820 | A | | 3/1998 | Wild et al. | 418/48 |
| 6,358,027 | B1 | | 3/2002 | Lane | 418/48 |

FOREIGN PATENT DOCUMENTS

| | | | | |
|---|---|---|---|---|
| DE | 26 32 716 | | 1/1978 | |
| EP | 0 284 780 | | 10/1988 | |
| FR | 1 189 580 | | 10/1959 | |
| FR | 1 284 388 | | 7/1962 | |
| GB | 1 583 582 | | 1/1977 | |
| IT | 544242 | * | 7/1956 | 418/48 |
| RU | 375408 | * | 3/1973 | 418/48 |
| RU | 400689 | * | 10/1973 | 418/48 |
| RU | 412367 | * | 1/1974 | 418/48 |
| SE | 140005 | * | 4/1953 | 418/48 |

* cited by examiner

*Primary Examiner*—John J. Vrablik
(74) *Attorney, Agent, or Firm*—Moser, Patterson & Sheridan, L.L.P.

(57) ABSTRACT

The present invention provides an adjustable rotor and/or stator, so that the interference fit and/or clearance can be adjusted. The rotor and/or stator are tapered to provide a difference in fit between the rotor and stator by longitudinal adjustment of their relative position. The relative longitudinal adjustment is achieved in response to a change in temperature and is matched to the taper angle of the stator/rotor to maintain a desired interference fit.

45 Claims, 17 Drawing Sheets

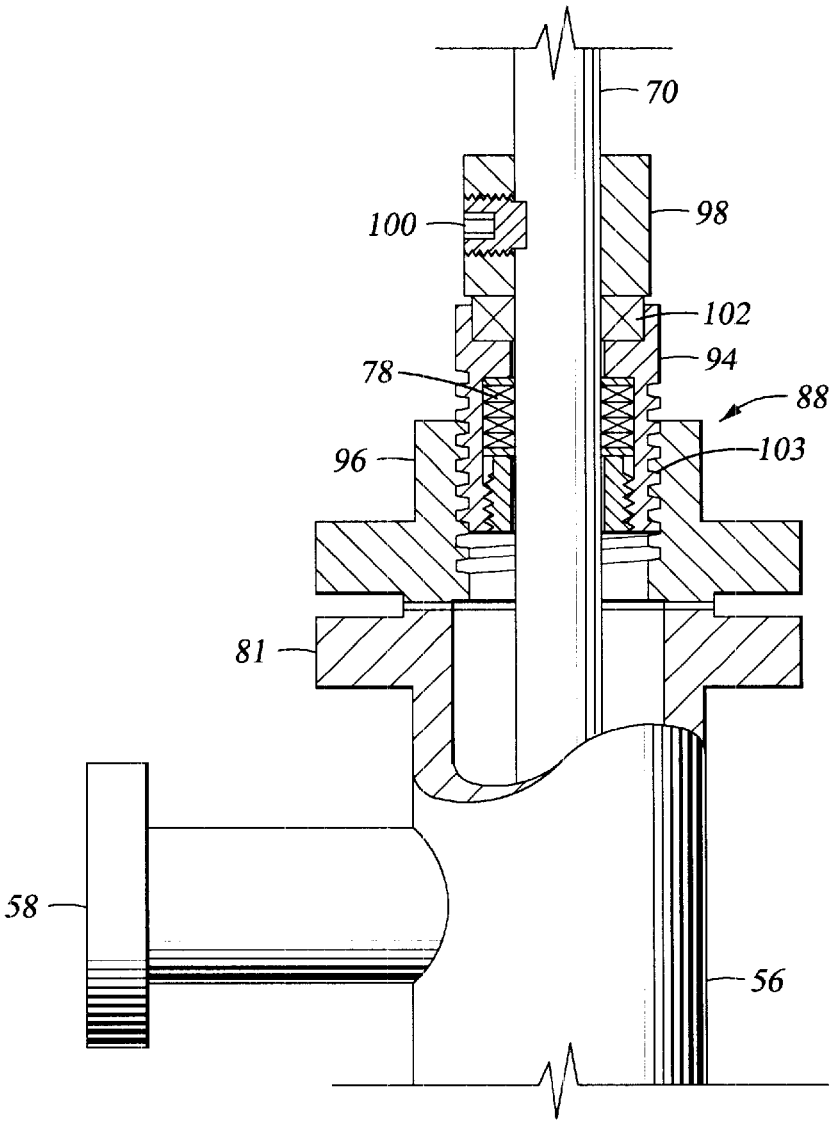
Fig. 30
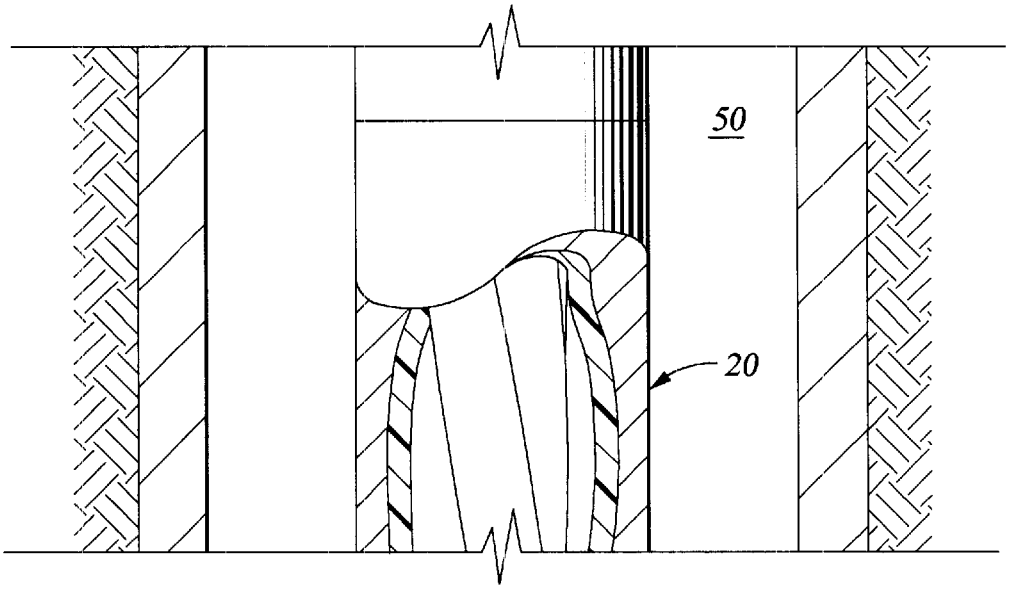

Fig. 37A
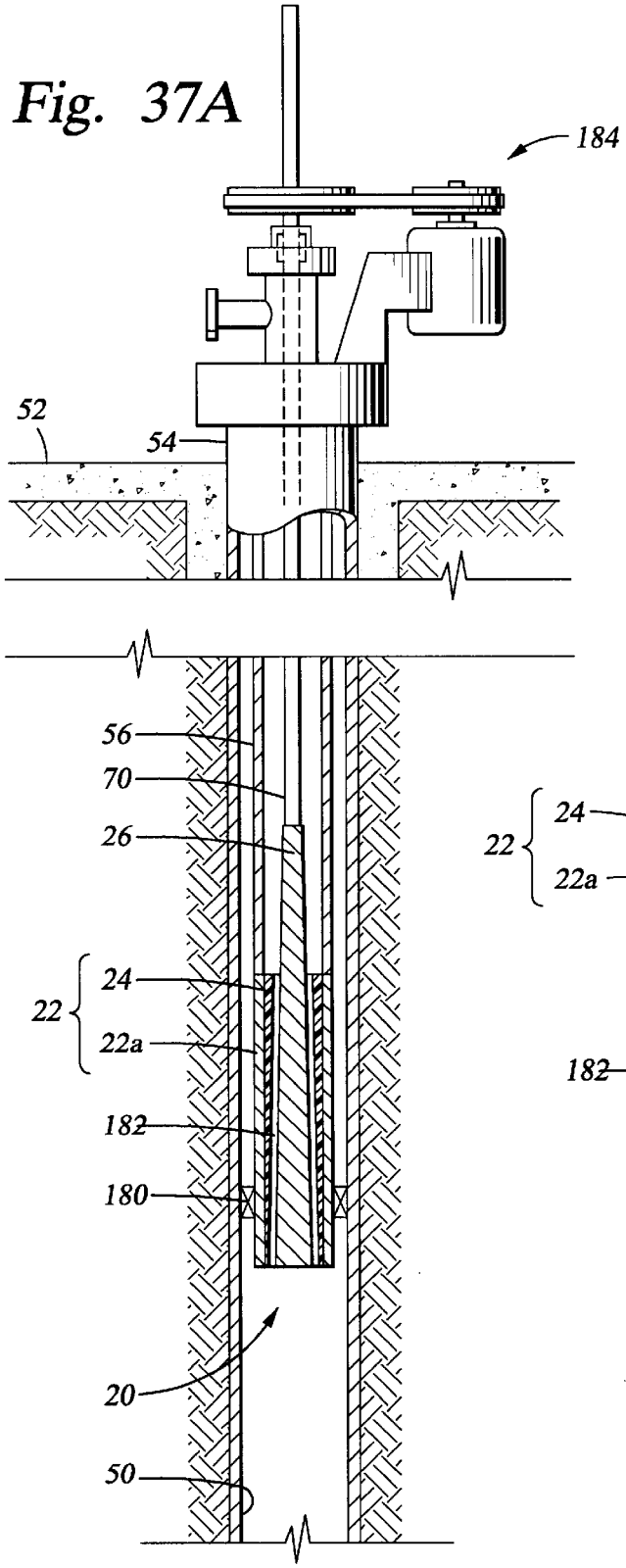
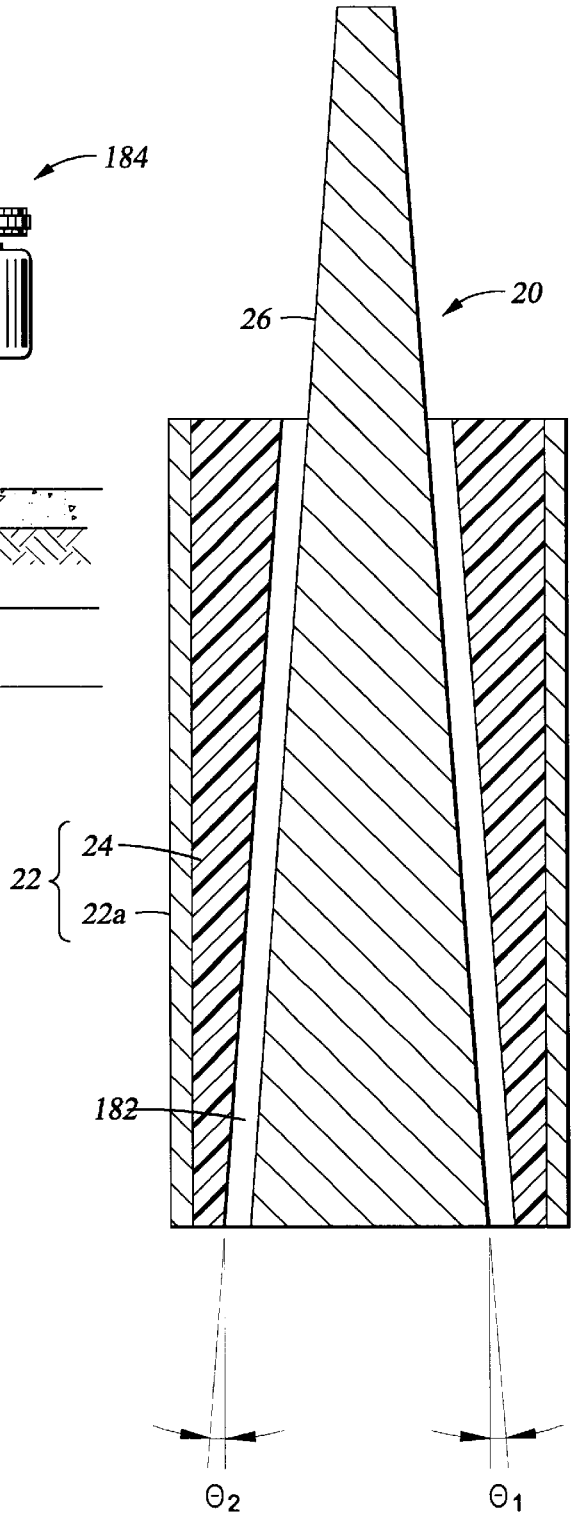
Fig. 37B

SELF COMPENSATING ADJUSTABLE FIT PROGRESSING CAVITY PUMP FOR OIL-WELL APPLICATIONS WITH VARYING TEMPERATURES

BACKGROUND OF THE INVENTION

1. Field of the Invention

The present invention relates to the equipment and methods in oil field operations. Particularly, the invention relates to pumps.

2. Background of the Related Art

Helical gear pumps, typically known as progressive cavity pumps/motors (herein PCPs), are frequently used in oil field applications, for pumping fluids or driving downhole equipment in the wellbore. A typical PCP is designed according to the basics of a gear mechanism patented by Moineau in U.S. Pat. No. 1,892,217, incorporated by reference herein, and is generically known as a "Moineau" pump or motor. The mechanism has two helical gear members, where typically an inner gear member rotates within a stationary outer gear member. In some mechanisms, the outer gear member rotates while the inner gear member is stationary and in other mechanisms, the gear members counter rotate relative to each other. Typically, the outer gear member has one helical thread more than the inner gear member. The gear mechanism can operate as a pump for pumping fluids or as a motor through which fluids flow to rotate an inner gear so that torsional forces are produced on an output shaft. Therefore, the terms "pump" and "motor" will be used interchangeably herein.

FIG. 1 is a schematic cross sectional view of a pumping/power section of a PCP. FIG. 2 is a schematic cross sectional view of the PCP shown in FIG. 1. Similar elements are similarly numbered and the figures will be described in conjunction with each other. The pumping section 1 includes an outer stator 2 formed about an inner rotor 4. The stator 2 typically includes an outer shell 2*a* and an elastomeric member 10 formed therein. The rotor 4 includes a plurality of gear teeth 6 formed in a helical thread pattern around the circumference of the rotor. The stator 2 includes a plurality of gear teeth 8 for receiving the rotor gear teeth 6 and typically includes one more tooth for the stator than the number of gear teeth in the rotor. The rotor gear teeth 6 are produced with matching profiles and a similar helical thread pitch compared to the stator gear teeth 8 in the stator. Thus, the rotor 4 can be matched to and inserted within the stator 2. The rotor typically can have from one to nine teeth, although other numbers of teeth can be made.

Each rotor tooth forms a cavity with a corresponding portion of the stator tooth as the rotor rotates. The number of cavities, also known as stages, determines the amount of pressure that can be produced by the PCP. Typically, reduced or no clearance is allowed between the stator and rotor to reduce leakage and loss in pump efficiency and therefore the stator 2 typically includes the elastomeric member 10 in which the helical gear teeth 8 are formed. Alternatively, the elastomeric member 10 can be coupled to the rotor 4 and engage teeth formed on the stator 2 in similar fashion. The rotor 4 flexibly engages the elastomeric member 10 as the rotor turns within the stator 2 to effect a seal therebetween. The amount of flexible engagement is referred to as a compressive or interference fit.

FIG. 3 is a cross sectional schematic view of diameters of the stator shown in FIGS. 1 and 2. A typical stator 2 has a constant minor diameter 3*a* defined by a circle circumscribing an inner periphery of the stator teeth 8. The typical stator also has a constant major diameter 5*a* defined by a circle circumscribing an outer periphery of the teeth 8. A thread height 7*a* is the height of the teeth, which is the difference between the major diameter and the minor diameter divided by two, i.e., a minor radius subtracted from a major radius.

FIG. 4 is a cross sectional schematic view of diameters of the rotor shown in FIGS. 1 and 2. The rotor 4 has minor and major diameters and a thread height to correspond with the stator. The typical rotor has a minor diameter 3*b* defined by a circle circumscribing an inner periphery of the teeth 6. The rotor also has a major diameter 5*b* defined by a circle circumscribing an outer periphery of the teeth 6. The thread height 7*b* is the difference between the major diameter and the minor diameter divided by two.

A PCP used as a pump typically includes an input shaft 18 that is rotated at a remote location, such as a surface of a wellbore (not shown). The input shaft 18 is coupled to the rotor 4 and causes the rotor 4 to rotate within the stator 2, as well as precess around the circumference of the stator. Thus, at least one progressive cavity 16 is created that progresses along the length of the stator as the rotor is rotated therein. Fluid contained in the wellbore enters a first opening 12, progresses through the cavities, out a second opening 14 and is pumped through a conduit coupled to the PCP. Similarly, a PCP used as a motor allows fluid to flow from typically a tubing coupled to the PCP, such as coiled tubing, through the second opening 14, and into the PCP to create hydraulic pressure. The progressive cavity 16 created by the rotation moves the fluid toward the first opening 12 and is exhausted therethrough. The hydraulic pressure, causing the rotor 4 to rotate within the stator 2, provides output torque to an output shaft 19 used to rotate various tools attached to the motor.

The rubbing of the rotor in the stator as the rotor rotates causes several problems. Various operating conditions change the interference fit and therefore a predetermined amount of interference is difficult to obtain for efficient performance under the varying conditions. One problem is that a PCP can encounter fluctuations in operating temperatures. For example, some wellbore operations inject steam downhole through the pump into a production zone and then reverse the flow to pump production fluids produced by the wellbore at a different temperature up the wellbore. The temperature fluctuations can cause the components, particularly the elastomeric member, to expand and change the interference fit between the stator and rotor. Accordingly, because PCPs operate effectively only within a narrow range of fit, PCPs are limited to operations in which the temperature remains substantially constant.

One attempt to overcome the problems associated with the operation of a PCP in a variable temperature environment is to periodically change the pump components to accommodate the current ambient temperature. For example, the rotor may be periodically exchanged for a rotor with different dimensions in order to maintain the desired interference fit. The effectiveness of this practice is limited because a single rotor size can only accommodate a narrow temperature range, e.g., about 20° C. to about 30° C. As a result, the rod string must be pulled from the well bore and the rotors must be changed too frequently to be a practical solution.

Therefore, there exists a need for providing a PCP that can be adjusted to a variety of selected interference fits or even clearances to meet various operating conditions.

SUMMARY

The present invention provides a self-compensating rotor and/or stator, so that the interference fit and/or clearance is maintained over a range of temperatures. The rotor and/or stator are tapered to provide a difference in fit between the rotor and stator by longitudinal adjustment of their relative position. In one embodiment, the adjustment may occur in response to a change in the length of a rod string while the PCP in mounted downhole in a wellbore.

In one aspect, a progressive cavity pump (PCP) having a inlet and an outlet is provided. The PCP comprises a stator defining a bore and a rotor slidably disposed in the bore. A shaft is connected to the rotor and has a length changing with temperature. The bore and the rotor are tapered at least partially between the inlet and the outlet so that a predetermined interference fit between the stator and the rotor is maintained during the change in the length.

In another aspect, a self-compensating progressive cavity pump (PCP) having a inlet and an outlet is provided. The PCP comprises a stator carrying an elastomeric member on an inner surface, wherein the elastomeric member has a thickness and a thermal expansion coefficient and wherein a surface of the elastomeric member defines a bore having an increasing diameter along at least a portion of its length. A rotor slidably disposed in the bore has at least a portion that increases diametrically along its length and has an outer surface defining a taper angle θ. The taper angle θ is selected to maintain a predetermined interference fit between the stator and the rotor during relative axial movement therebetween. A shaft connected to the rotor has a length that increases with an increasing temperature, whereby the. rotor is axially moved relative to the stator when the stator is fixed in position. In one embodiment, the taper angle θ is determined according to at least the thermal expansion coefficient of the elastomeric member, the thickness of the elastomeric member, the length of the shaft and a thermal expansion coefficient of the shaft.

In yet another aspect, a self-compensating progressive cavity pump (PCP) comprises a rotor disposed in the bore of a stator; wherein the stator and the rotor define interfacing inclining surfaces adapted to move over one another and defining an interference fit that is maintained while the rotor is axially reciprocating within the bore in response to a change in an ambient temperature.

In another aspect, a method of adjusting a progressive cavity pump as a function of temperature is provided. The method comprises a) providing a rotor slidably disposed in an opening of a stator, wherein the stator and rotor comprise interfacing inclined surfaces; b) axially moving the rotor and the stator relative to one another as a function of temperature; and c) maintaining a desired interference fit between the interfacing inclined surfaces while performing step b).

BRIEF DESCRIPTION OF DRAWINGS

FIG. 30 is a schematic cross sectional view of one embodiment of an adjustor for a shaft.

FIG. 37A is a schematic cross sectional view of one embodiment of a self-compensating PCP in a first position and located in a well bore.

FIG. 37B is a schematic cross sectional view of the PCP of FIG. 37A.

DETAILED DESCRIPTION OF A PREFERRED EMBODIMENT

Figure 5:
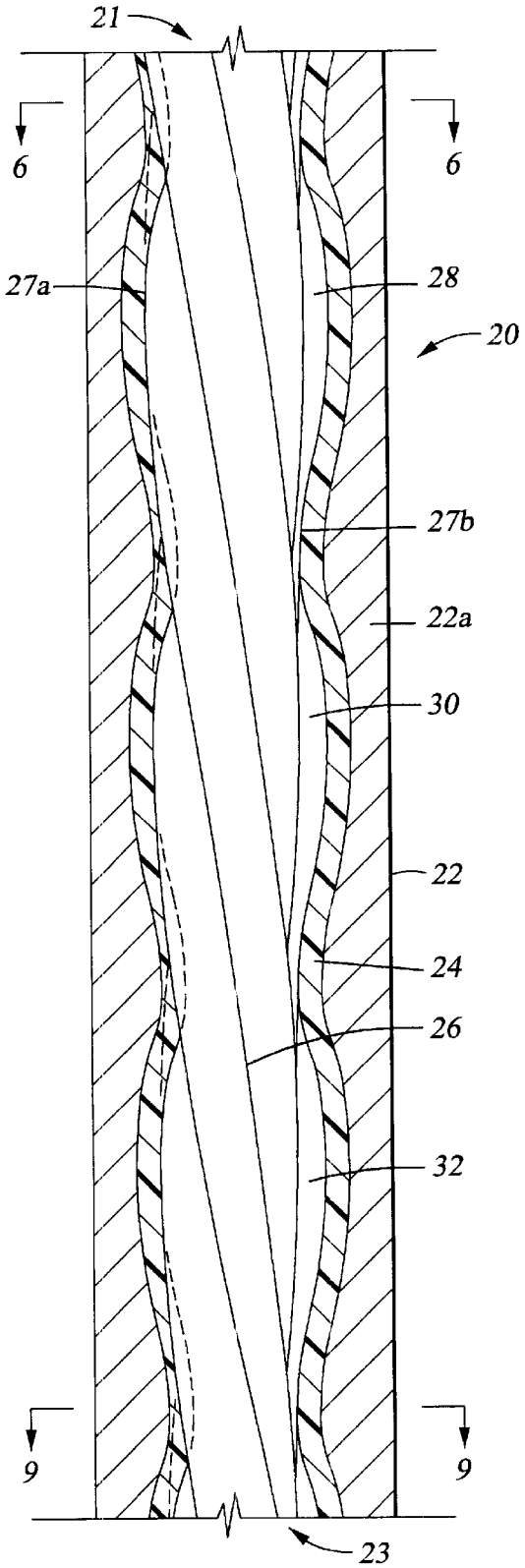
FIG. 5 is a schematic cross sectional view of a portion of a PCP having a tapered rotor.

FIG. 5 is a schematic cross sectional view of a portion of a PCP. The PCP 20 has a rotor and/or stator with a tapered cross section. In one embodiment, the rotor and stator are tapered diametrically. That is, the rotor is tapered progressively smaller at a minor diameter of the rotor from a first portion 21 to a second portion 23 of the PCP 20. Similarly, the stator could be tapered progressively smaller from the first portion 21 to the second portion 23 to correspond to the rotor. Alternatively, the tapers can be progressively larger from the first portion to the second portion. Generally, in some embodiments, the fit/clearance between the rotor and the stator is relatively constant if the tapers on the rotor and stator are uniform. In other embodiments, the fit/clearance itself can be tapered if the tapers of the rotor and stator are nonuniform.

The PCP 20 includes a stator 22, having a shell 22*a* and a elastomeric member 24 generally coupled to the shell 22*a,* and a rotor 26 disposed therethrough. Generally, the shell 22*a* and the rotor 26 are made of metallic material such as steel. For illustrative purposes, the stator 22 includes the elastomeric member 24. However, it is to be understood herein that the elastomeric member could be coupled to the rotor 26 and the stator shell formed with corresponding helical threads. Further, the PCP 20 may be formed without a separate elastomeric member, if, for example, the rotor and/or stator is formed with suitable materials or enough clearance is designed into the components. For example, the rotor and/or stator can be formed from composite materials, such as fiberglass, plastics, hydrocarbon-based materials and other structural materials, and may include strengthening members, such as fibers embedded in the material. Generally, the interface between the rotor and stator is flexible and yet retains structural integrity and resists abrasion. However, the interface can be substantially rigid if, for example, sufficient clearance is provided between the rotor and stator. Thus, statements herein regarding the interaction between the stator, the elastomeric member, and the rotor include any of the above combinations.

Figure 1:
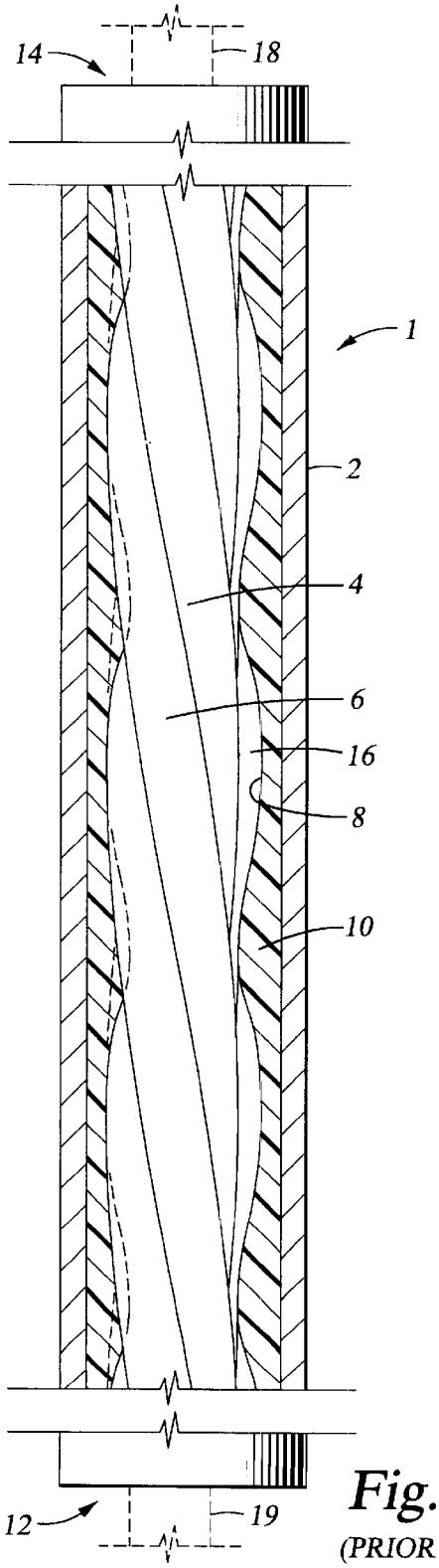
Fig. 1 (PRIOR ART)
FIG. 1 is a schematic cross sectional view of a pumping/motor section of a progressive cavity pump (PCP).
Figure 2:
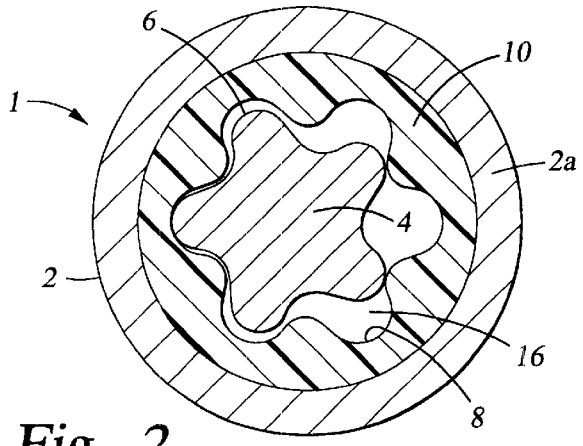
Fig. 2 (PRIOR ART)
FIG. 2 is a schematic cross sectional view Of the pumping/power section of the PCP shown in FIG. 1.
Figure 3:
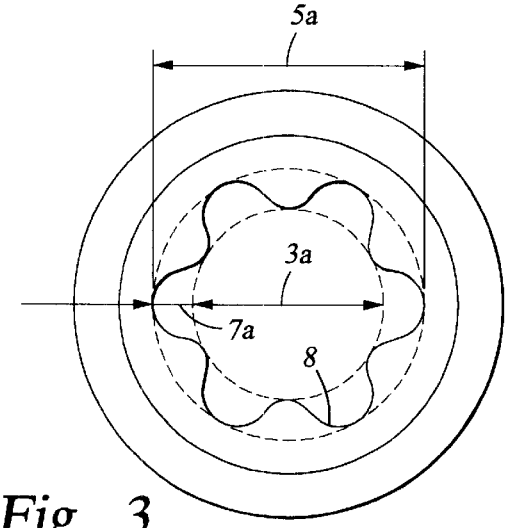
Fig. 3 (PRIOR ART)
FIG. 3 is a schematic cross sectional view of diameters of the stator shown in FIGS. 1 and 2.
Figure 4:
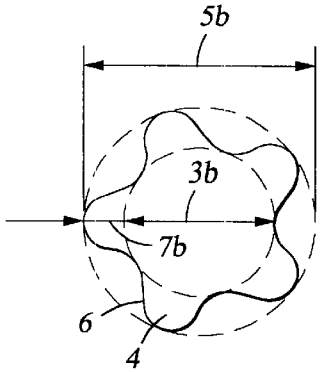
Fig. 4 (PRIOR ART)
FIG. 4 is a schematic cross sectional view of diameters of the rotor shown in FIGS. 1 and 2.

In one embodiment, the stator shell 22*a* is formed with threads and the elastomeric member 24 formed thereon. For example, the threads can be formed in the shell and the elastomeric member formed by coating the shell with elastomeric material, such as rubber, Buna-N, nitrile-based elastomers, fluoro-based elastomers, Teflon®, silicone, plastics, other elastomeric materials or combinations thereof. The elastomeric member could have a relatively constant thickness. Alternatively, the elastomeric member could be formed with a varying thickness, as shown in FIGS. 1–2, for any of the embodiments described herein.

The placement of the rotor 26 in the stator 22 creates a first cavity 28, a second cavity 30 and a third cavity 32. For the purposes of the example, three cavities are shown. However, it is to be understood that the number of cavities can vary depending on the number of stages desired in the PCP. Further, the cavities progress in position up and down the length of the PCP as the rotor 26 rotates within the stator 22. The contact of the rotor 26 with the elastomeric member 24 generally creates an interference fit, such as shown at portions 27*a* and 27*b*. The interference fit can vary depending on the operating conditions, as explained in reference to FIGS. 6–15.

Figure 6:
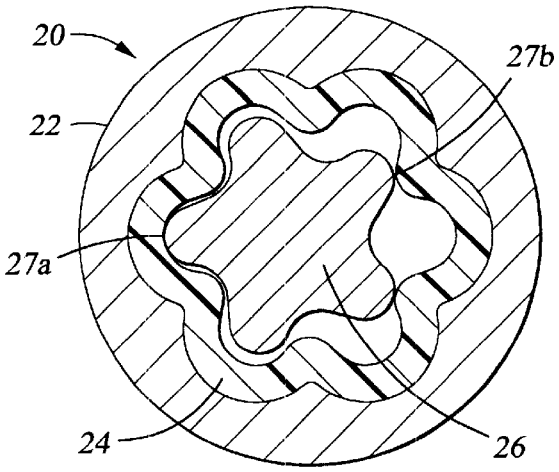
FIG. 6 is a schematic cross sectional view of the pumping/power section of the PCP shown in FIG. 5 at section 6.
Figure 7:
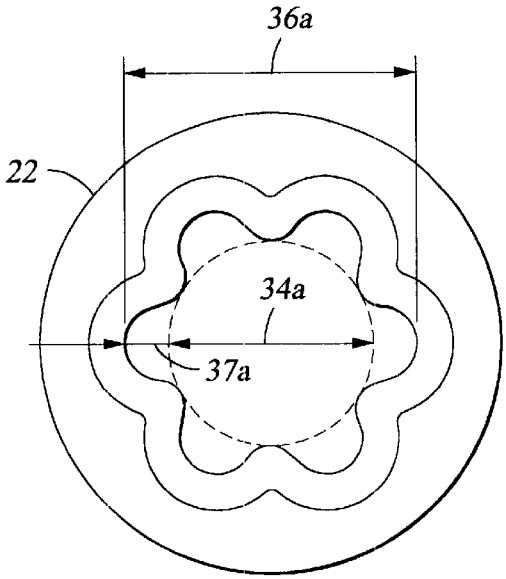
FIG. 7 is a schematic cross sectional view of diameters of the stator shown in FIG. 6.
Figure 8:
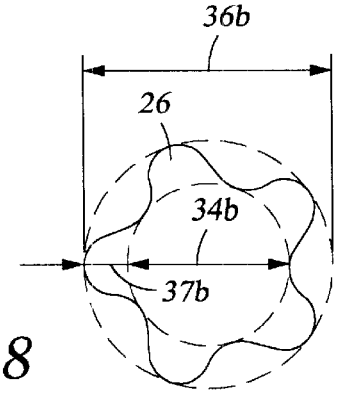
FIG. 8 is a schematic cross sectional view of diameters of the rotor shown in FIG. 6.

FIG. 6 is a schematic cross sectional view of the pumping/power section of the PCP shown in FIG. 5 at section 6. FIG. 7 is a schematic cross sectional view of diameters of the stator shown in FIG. 6. FIG. 8 is a schematic cross sectional view of diameters of the rotor shown in FIG. 6. FIGS. 6–8 will be described jointly and similar elements are similarly numbered. The rotor 26 is disposed within the stator 22. The elastomeric member 24 engages the rotor as the rotor rotates within the stator. For example, the rotor engages the elastomeric member at a portion 27*a* and a distal portion 27*b* and generally forms an interference fit with the stator through the elastomeric member. The stator has a minor diameter 34*a,* a major diameter 36*a* and a resulting thread height 37*a,* shown in FIG. 7. The rotor has a corresponding minor diameter 34*b,* a major diameter 36*b* and a resulting thread height 37*b,* shown in FIG. 8. The rotor and/or stator have a relatively constant thread height, i.e., the height of the threads are the same across the two or more of the stages of the PCP 20. Thus, as the rotor and/or stator diminish in cross sectional area, the teeth remain a constant height.

Figure 9:
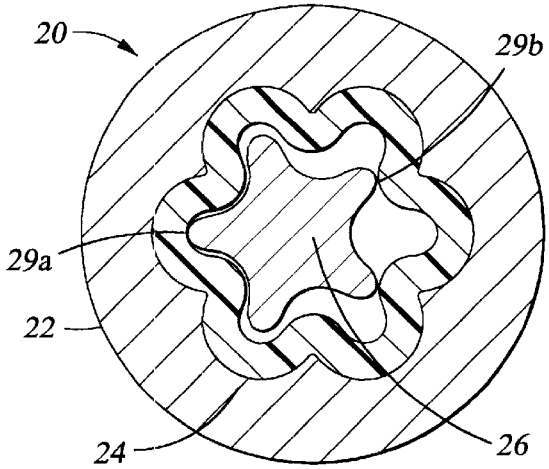
FIG. 9 is a schematic cross sectional view of the pumping/power section of the PCP shown in FIG. 5 at section 9.
Figure 10:
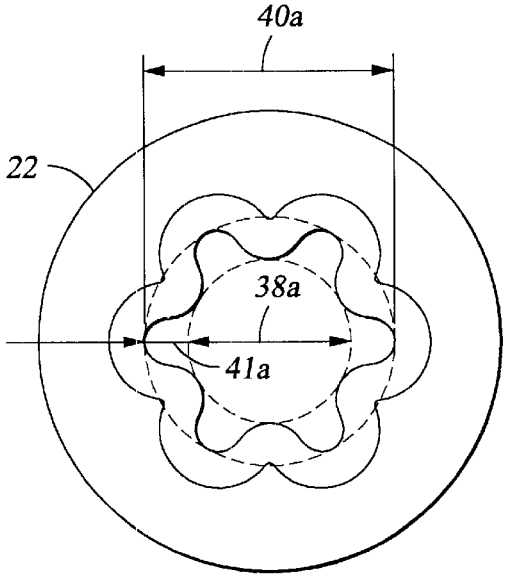
FIG. 10 is a schematic cross sectional view of diameters of the stator shown in FIG. 9.
Figure 11:
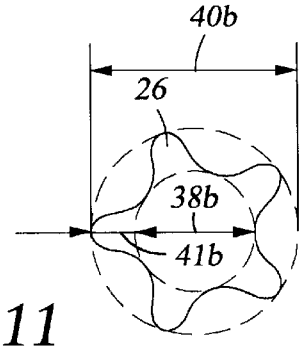
FIG. 11 is a schematic cross sectional view of diameters of the rotor shown in FIG. 9.

FIG. 9 is a schematic cross sectional view of the pumping/power section of the PCP shown in FIG. 5 at section 9. FIG. 10 is a schematic cross sectional view of diameters of the stator shown in FIG. 9. FIG. 11 is a schematic cross sectional view of diameters of the rotor shown in FIG. 9. FIGS. 9–11 will be described jointly and have similar elements similarly numbered. The stator has a minor diameter 38*a,* a major diameter 40*a* and a resulting thread height 41*a,* shown in FIG. 10. The rotor has a corresponding minor diameter 38*b,* a major diameter 40*b* and a resulting thread height 41*b,* shown in FIG. 11.

The rotor 26 is smaller in cross sectional area at section 9 than at section 6, shown in FIG. 5, and can form a progressive taper in at least a portion of the pumping section of the PCP 20. However, the elastomeric member 24 engages the rotor as the rotor rotates within the stator, because the stator is tapered correspondingly to the rotor. For example, the rotor engages the elastomeric member at a portion 29*a* and a distal portion 29*b* and generally forms an interference fit with the stator through the elastomeric member.

Figure 12:
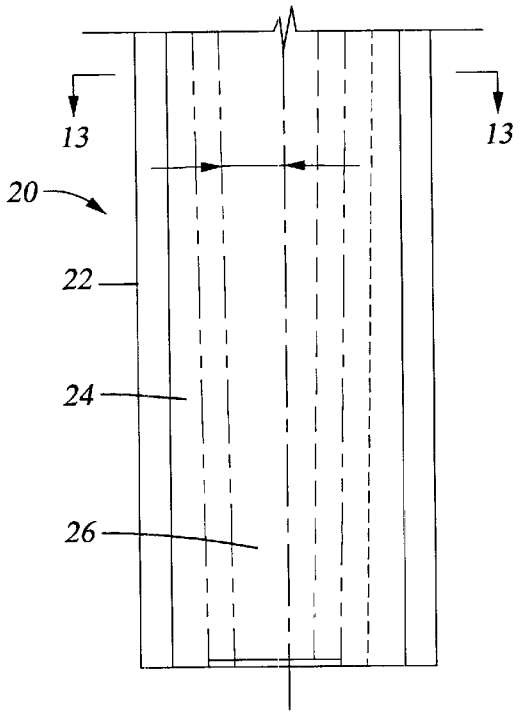
FIG. 12 is a schematic cross sectional view of a portion of a PCP having a tapered rotor in a first position.
Figure 13:
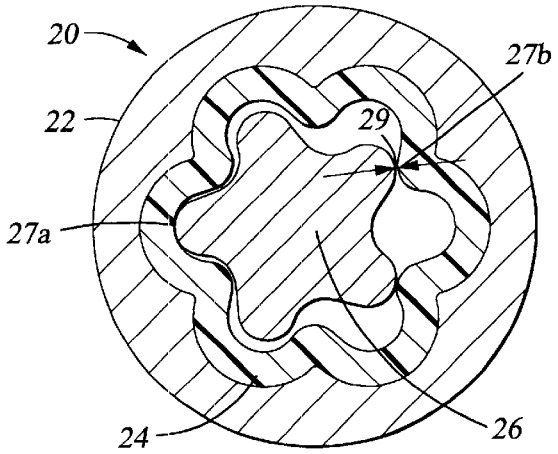
FIG. 13 is a schematic cross sectional view of the pumping/power section of the PCP shown in FIG. 12 at section 13.

FIG. 12 is a schematic cross sectional view of a portion of the PCP 20 with the tapered rotor and/or stator in a first position. FIG. 13 is a schematic cross sectional view of the pumping/power section of the PCP shown in FIG. 12 at section 13. Similar elements are similarly numbered and the figures will be described jointly. When the rotor is engaged with the stator, the relative fit between the rotor and stator is in a first condition, so that, for example, normal pumping can occur. The first condition could be a predetermined operating condition for which the pump was designed without wear and swelling of the components. The rotor can contact the stator at, for example, portions 27*a* and 27*b*.

Figure 14:
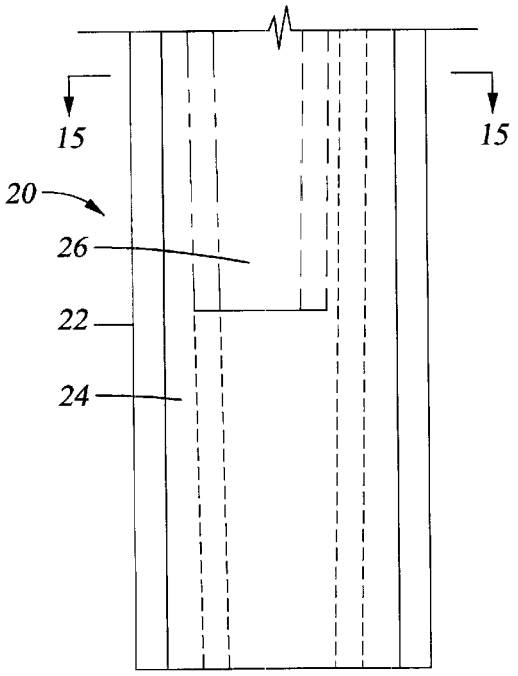
FIG. 14 is a schematic cross sectional view of a portion of a PCP having a tapered rotor in a second position.
Figure 15:
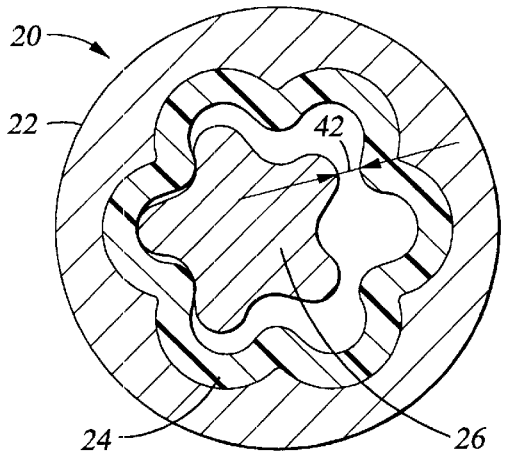
FIG. 15 is a schematic cross sectional view of the pumping/power section of the PCP shown in FIG. 14 at section 15.

FIG. 14 is a schematic cross sectional view of a portion of a PCP having the tapered rotor 26 in a second position. FIG. 15 is a schematic cross sectional view of the pumping/power section of the PCP 20 shown in FIG. 14 at section 15 and will be described jointly with FIG. 14. The rotor 26 has been adjusted in the direction of the larger diameters of the stator, which is upward in FIG. 14. The fit between the rotor and the stator in the second position is different than the fit in the first position. As an example, FIG. 15 shows a clearance 42 between the rotor and the stator in contrast to the interference fit shown in FIG. 9. The adjustment between the rotor and stator fit can be made manually or automatically and can account for variations in operating conditions. For example, the fit between the rotor and the elastomeric member could be increased to achieve increased pumping efficiency, if the elastomeric member 24 was worn. Further, if an operation temporarily expands the elastomeric member, such as pumping steam downhole, the rotor can be adjusted for a looser fit to allow for the expansion and then readjusted to a desired fit after the expansion subsides.

As another example, a pump disposed downhole generally leaves a column of fluid above the pump that impedes the pump when it starts to rotate again. The relative position of the rotor with the stator can be adjusted to provide clearance and "unload" the pump to drain the column of fluid. Thus, the pump can start easier and lessen an initial load on, for example, an electric motor driving the pump.

Conversely, the rotor could be moved to a second position that is further inward toward the second portion 23, shown in FIG. 5, compared to the first position, i.e., in the direction of the smaller rotor diameter. Further, it may be desirable to selectively change an interference fit to different interference fit or even a clearance fit to allow passage of various fluids, such as fluids containing particulate matter.

Figure 16:
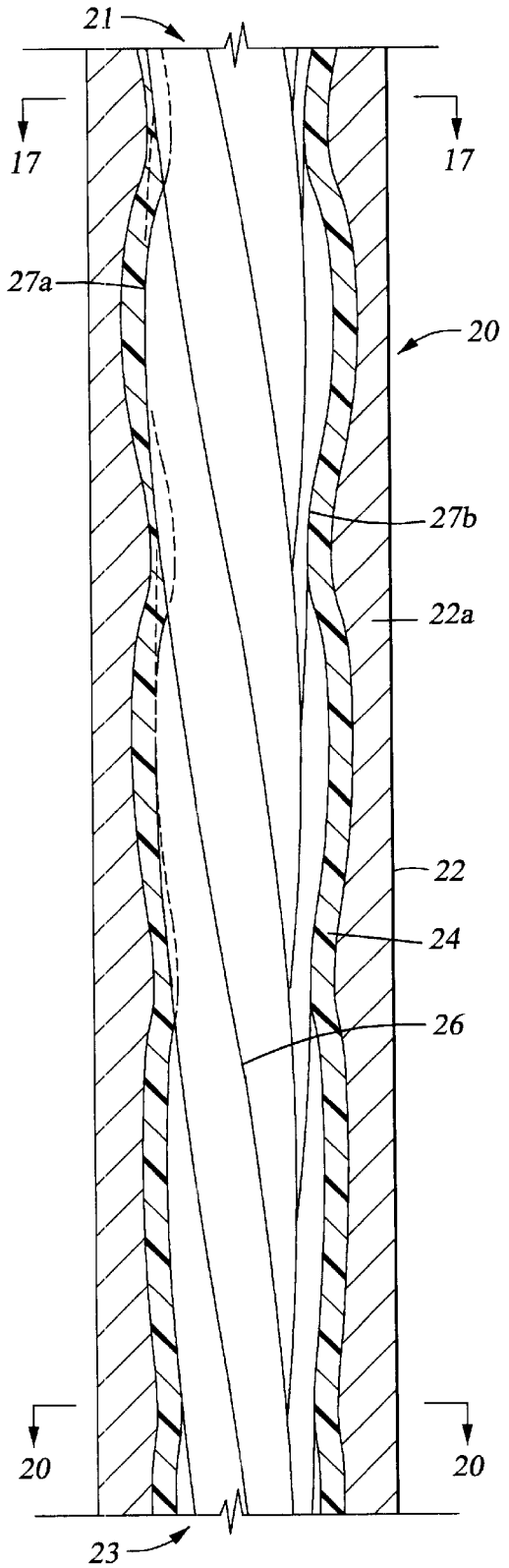
FIG. 16 is a schematic cross sectional view of a portion of a PCP having a tapered thread height.

FIG. 16 is a schematic cross sectional view of a portion of a PCP having a tapered thread height. The PCP 20 includes a stator 22 with an elastomeric member 24 and a rotor 26 disposed therethrough. The placement of the rotor 26 in the stator 22 creates a first cavity 28, a second cavity 30 and a third cavity 32, described in reference to FIG. 5.

Figure 17:
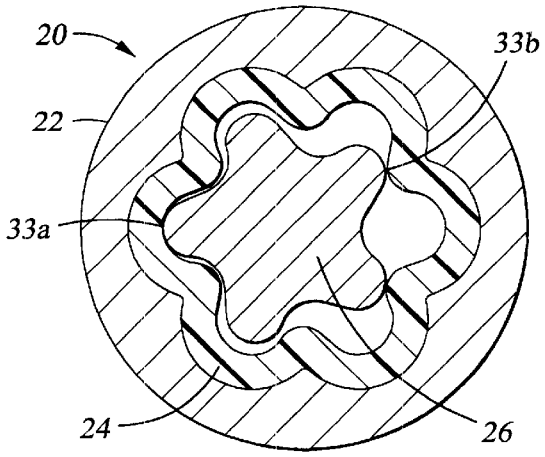
FIG. 17 is a schematic cross sectional view of the pumping/power section of the PCP shown in FIG. 16 at section 17.
Figure 18:
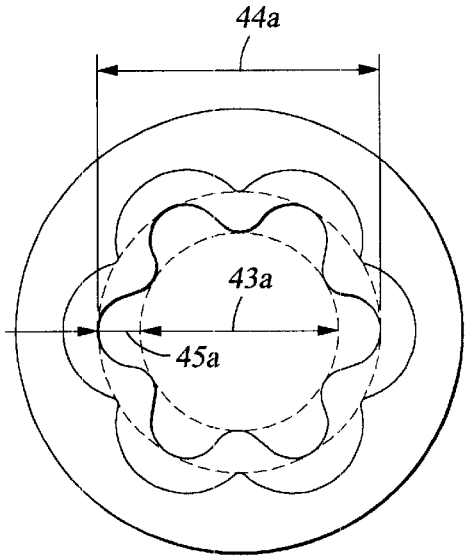
FIG. 18 is a schematic cross sectional view of diameters of the stator shown in FIG. 17.
Figure 19:
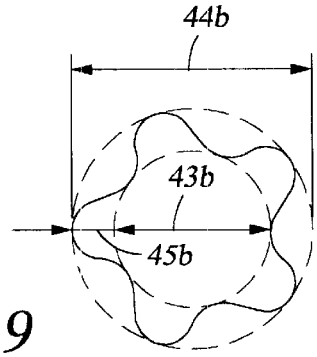
FIG. 19 is a schematic cross sectional view of diameters of the rotor shown in FIG. 17.

FIG. 17 is a schematic cross sectional view of the pumping/power section of the PCP shown in FIG. 16 at section 17. FIG. 18 is a schematic cross sectional view of diameters of the stator shown in FIG. 17. FIG. 19 is a schematic cross sectional view of diameters of the rotor shown in FIG. 17. FIGS. 17–19 will be described jointly and similar elements are similarly numbered. The rotor 26 is disposed within the stator 22. The elastomeric member 24 engages the rotor as the rotor rotates within the stator. For example, the rotor engages the elastomeric member at a portion 33*a* and engages a distal portion 33*b* at least partially along the helical threads to generally form an interference fit with the stator through the elastomeric member. Alternatively, the elastomeric member can be coupled to the rotor and engage teeth formed on the stator in similar fashion, as has been described herein. The stator has a minor diameter 43*a*, a major diameter 44*a* and a resulting thread height 45*a*, shown in FIG. 18. The rotor has a corresponding minor diameter 43*b*, a major diameter 44*b* and a resulting thread height 45*b*, shown in FIG. 19. In one embodiment, the rotor and/or stator have a constant minor diameter at least partially along the length of the PCP 20, i.e., the minor diameter is the same across two or more of the stages of the PCP 20. Alternatively, the minor and/or major diameters can taper as well as the thread height, so that the diameters and the thread height progressively taper along the rotor and/or stator.

Figure 20:
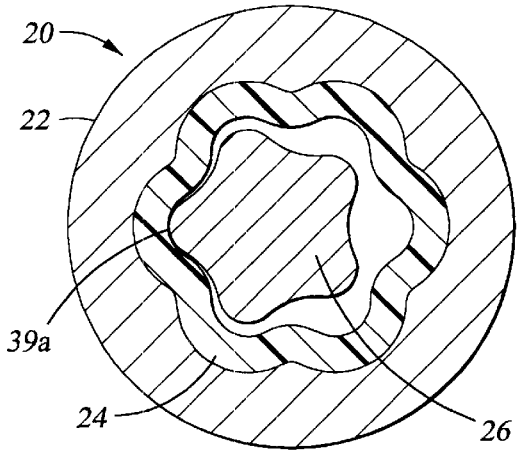
FIG. 20 is a schematic cross sectional view of the pumping/power section of the PCP shown in FIG. 16 at section 20.
Figure 21:
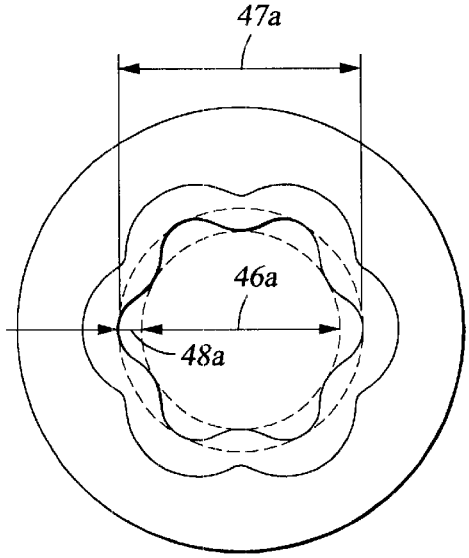
FIG. 21 is a schematic Gross sectional view of diameters of the stator shown in FIG. 20.
Figure 22:
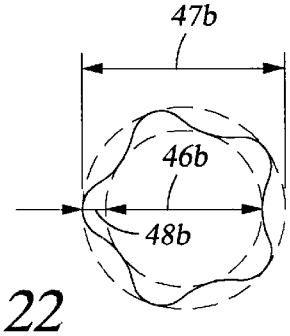
FIG. 22 is a schematic cross sectional view of diameters of the rotor shown in FIG. 20.

FIG. 20 is a schematic cross sectional view of the pumping/power section of the PCP shown in FIG. 16 at section 20. FIG. 21 is a schematic cross sectional view of diameters of the stator shown in FIG. 20. FIG. 22 is a schematic cross sectional view of diameters of the rotor shown in FIG. 20. FIGS. 20–22 will be described jointly and similar elements are similarly numbered. The stator has a minor diameter 46*a*, a major diameter 47*a* and a resulting thread height 48*a*, shown in FIG. 21. The rotor has a corresponding minor diameter 46*b*, a major diameter 47*b* and a resulting thread height 48*b*, shown in FIG. 22.

The rotor 26 has a smaller thread height at section 17 than at section 20, shown in FIG. 16, and can form a progressive taper in at least a portion of the pumping section of the PCP 20. The elastomeric member 24 engages the rotor as the rotor rotates within the stator, because the stator is tapered correspondingly to the rotor. For example, the rotor engages the elastomeric member at a portion 39*a*.

Figure 23:
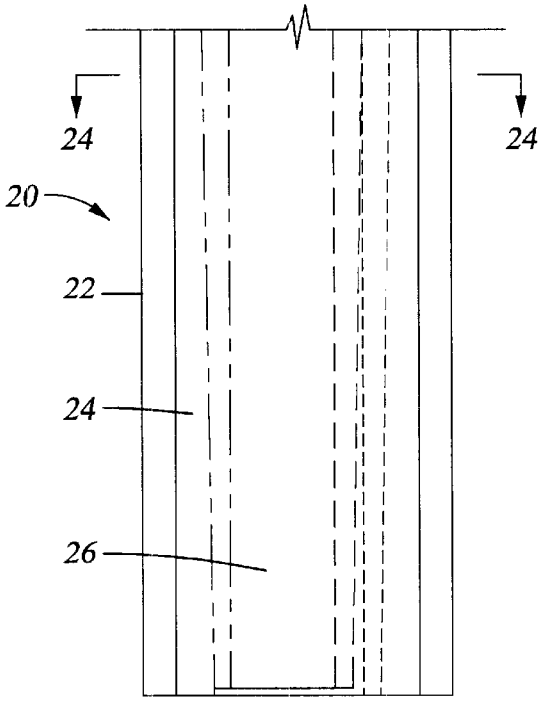
FIG. 23 is a schematic cross sectional view of a portion of a PCP having a tapered rotor in a first position.
Figure 24:
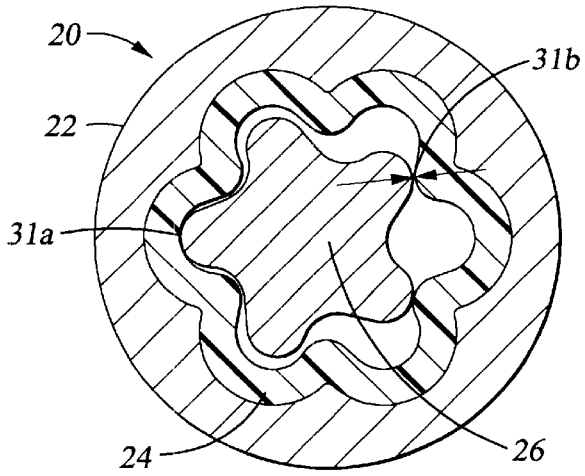
FIG. 24 is a schematic cross sectional view of the pumping/power section of the PCP shown in FIG. 23 at section 24.

FIG. 23 is a schematic cross sectional view of a portion of the PCP 20 with the tapered rotor and/or stator in a first position. FIG. 24 is a schematic cross sectional view of the pumping/power section of the PCP shown in FIG. 23 at section 24. Similar elements are similarly numbered and the figures will be described jointly. When the rotor is engaged with the stator, the relative fit between the rotor and stator is in a first condition, so that, for example, normal pumping can occur. The first condition could be a predetermined operating condition for which the pump was designed without wear and expansion of the components. The rotor can contact the stator at, for example, portions 31*a* and 31*b*.

Figure 25:
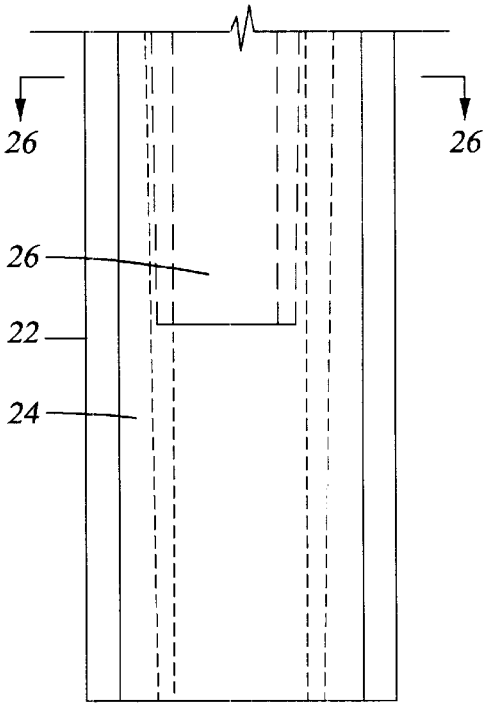
FIG. 25 is a schematic cross sectional view of a portion of a PCP having a tapered rotor in a second position.
Figure 26:
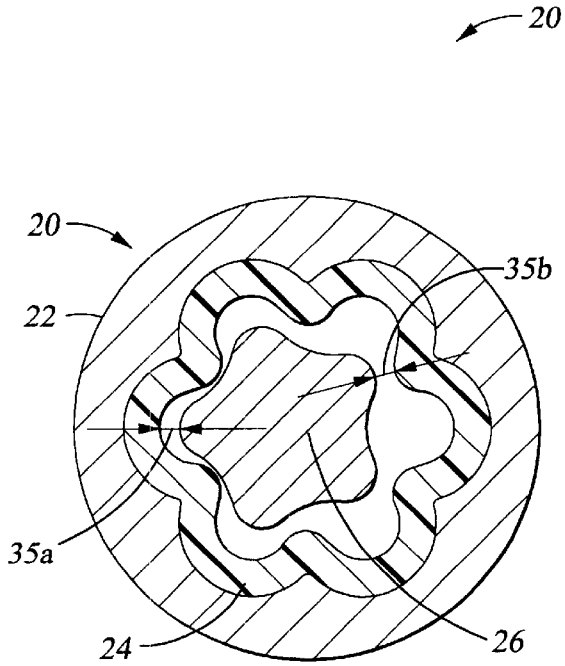
FIG. 26 is a schematic cross sectional view of the pumping/power section of the PCP shown in FIG. 25 at section 26.

FIG. 25 is a schematic cross sectional view of a portion of a PCP having the tapered rotor 26 in a second position. FIG. 26 is a schematic cross sectional view of the pumping/power section of the PCP 20 shown in FIG. 25 at section 26 and will be described jointly with FIG. 25. The rotor 26 has been adjusted in the direction of the larger thread height of the stator, which is upward in FIG. 25. The fit between the rotor and the stator in the second position is different than the fit in the first position. As an example, FIG. 26 shows a clearance 35*b* between the rotor and the stator. Further, a clearance 35*a* may also occur between the rotor and the stator because of the difference in thread heights.

Figure 27:
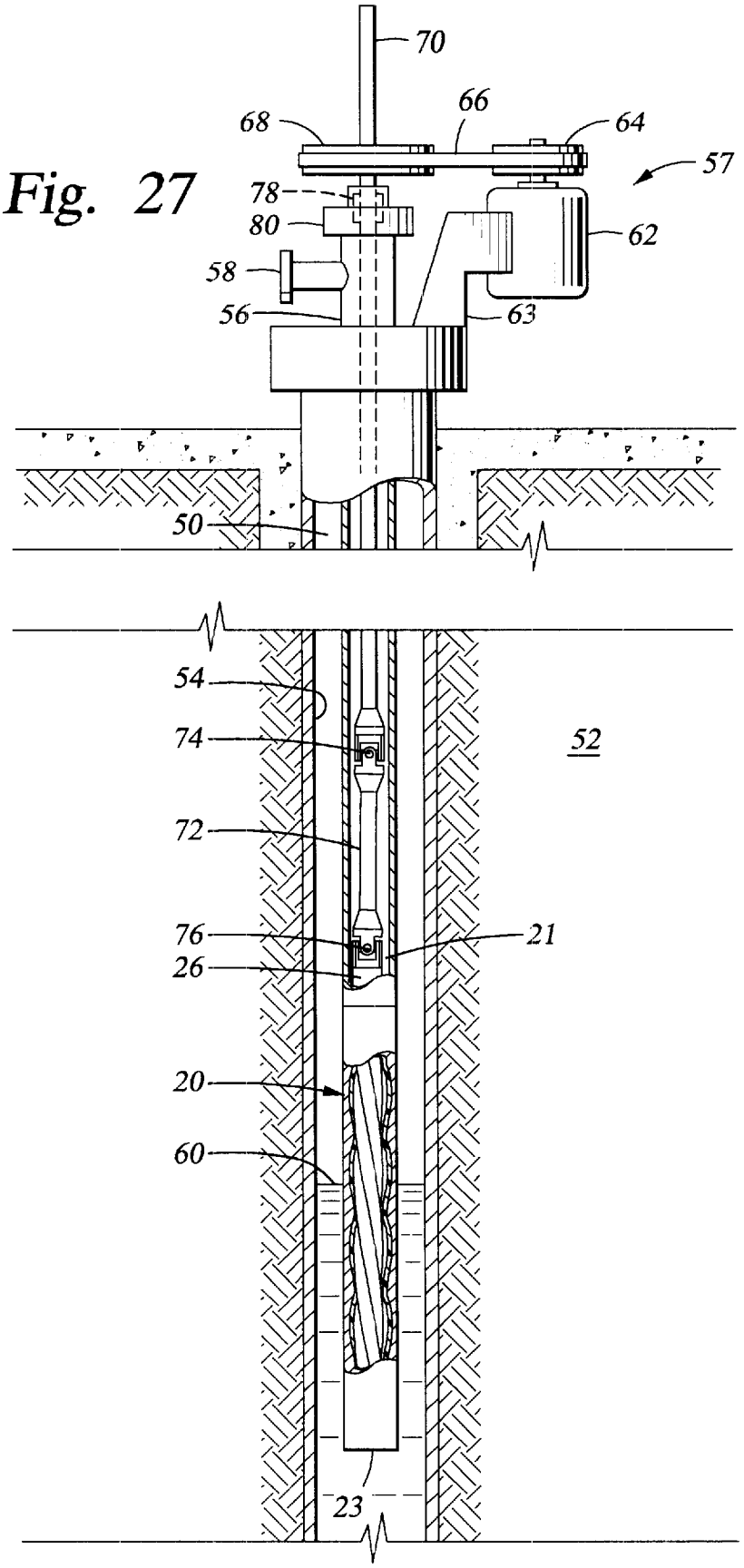
FIG. 27 is a schematic cross sectional view of a PCP mounted downhole in a wellbore.
Figure 28:
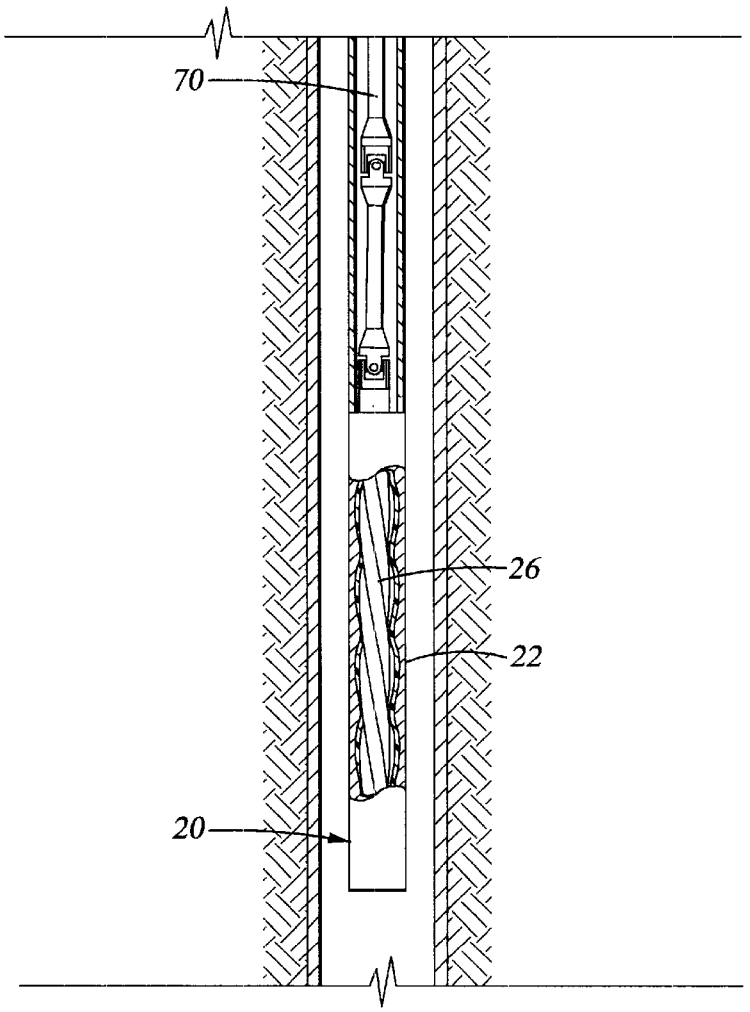
FIG. 28 is a schematic cross sectional view of a shaft coupled to a motor.

FIG. 27 is a schematic cross sectional view of a PCP mounted downhole in a wellbore. The PCP 20 is disposed in a wellbore 50 formed in the earth 52, which includes dry land or subsea formations. Generally, the wellbore 50 is cased with a casing 54 to stabilize the hole in the earth 52. A tubular member 56 is generally inserted into the wellbore 50 for flowing fluids from or to the PCP 20. The tubular member 56 includes a port 58 through which fluids can enter and exit the tubular member 56. If the PCP 20 is used as a pump, generally, the wellbore contains some amount of production fluid 60. The PCP 20 is actuated by a drive assembly 57 located at the surface of the wellbore 50. The drive assembly 57 includes a motor 62 and a support member 63 coupled to the PCP 20 through a drive member 64, a drive transfer member 66 coupled to the drive member 64, a second drive member 68 coupled to the drive transfer member 66 and a shaft 70 coupled to the second drive member 68. Coupling, as used herein, can include attaching, affixing, manufacturing, molding, linking, relating or otherwise associating elements together, which can be direct or indirect through intermediate elements. Alternatively, the motor 62 can be coupled directly to the shaft 70 without the intermediate drive members, as shown in FIG. 28. The drive member 64 can be, for example, a pulley or sprocket, the drive transfer member 66 can be a chain or belt, and the second drive member can be a corresponding pulley or sprocket. The shaft 70 can be inserted through the tubular member 56 and through a bearing and/or packing element 78 disposed in a top 80. The top 80 can be coupled to the tubular member 56. The shaft 70 is coupled to the rotor 26 by an intermediate shaft 72 having generally two universal joints 74 and 76 coupled therebetween. The universal joints allow the rotor 26 to precess as well as rotate within the stator 22. Fluid can be pumped up the wellbore from the second opening 23 through the progressive cavities formed between the stator 22 and the rotor 26 and then through the tubular member 56 and out the port 58. Conversely, fluid can be pumped downhole by entering the port 58, translating the fluid down the tubular member 56 through the first opening 21 and out the second opening 23. If the PCP 20 is used as a downhole motor, generally, the tubular member 56 would be used to flow fluid downward through the first opening 21 and out the second opening 23. The motor 26 would be coupled to a drive shaft extending from the rotor through the second opening 23 for operating downhole equipment, such as mills and drill bits.

FIG. 28 is a schematic cross sectional view of a shaft coupled to a drive assembly 59. The wellbore 50 includes a tubular member 56 inserted therein and a shaft 70 extending therethrough. The drive motor 62 is shown directly coupled to the shaft 70 through a polish clamp rod 84 as an alternative embodiment compared to the arrangement shown in FIG. 27. The motor 62 is supported by a support member 65. The support member 65 can be a stationary support member, such as a steel frame, or can be adjustable by using, for example, hydraulic or pneumatic cylinders, adjustable brackets that can be bolted in various positions, and other devices and methods. The motor 62 generally includes a drive shaft 82 which can be engaged with the polish clamp rod 84 on one end of the polish clamp rod. The polish clamp rod 84 can be engaged with the shaft 70 on another end of the polish clamp rod. The polish clamp rod may be a fixed engagement, such that there is little to no rotational movement relative between the drive shaft 82 and the shaft 70. Alternatively, the polish clamp rod 84 can be a slip or frictional drive coupling known to those in the art, such that the coupling may slip under certain conditions, such as an excessive amount of torque on the shaft 70. The shaft 70 can be adjusted longitudinally up and down relative to the polish clamp rod 84 and relative to the stator 22. The adjustments can change the relative position of the rotor 26 with the stator 22, described in FIGS. 5–26. An adjustor 88 can be used to longitudinally translate or adjust the shaft 70. One exemplary adjustor 88 will be described in FIG. 30. The length of the coupling engaged with the shaft 70 can be determined by the amount of the adjustment anticipated for the shaft 70 as the rotor 26 is longitudinally adjusted in the PCP 20. Similarly, the motor 62 and the shaft 70 can both be longitudinally adjusted to change the rotor and stator engagement positions.

Further, in the embodiment shown in FIG. 28, the shaft 70 is shown to be adjusted by the adjustor 88, so that the rotor is adjusted relative to the stator, where the stator is relatively stationary. The adjustor 88 may also adjust the stator, for example, by adjusting the tubular member 56 up and down the wellbore 50, while the shaft 70 and rotor 26 attached thereto remain relatively stationary. Further, both the rotor and the stator can be adjusted longitudinally. For example, the adjustor 88 could be coupled to the support member 65 as shown in dotted lines, for example, to adjust both components.

Figure 29:
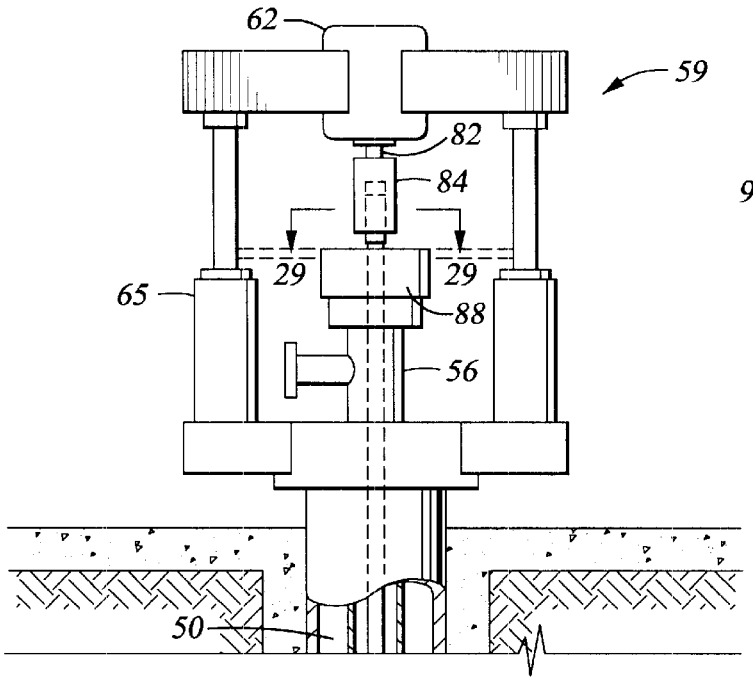
FIG. 29 is a schematic cross sectional view of a polish clamp rod 84 engaged with the shaft 70 shown in FIG. 28.
Figure 29:
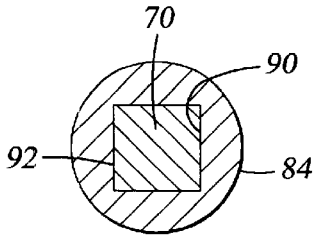

FIG. 29 is a schematic cross sectional view of the polish clamp rod 84 engaged with the shaft 70, shown in FIG. 28. As one example, the polish clamp rod 84 has a rectangular opening with edges 90 that engage a correspondingly shaped portion 92 on the shaft 70. As another example, the polish clamp rod 84 can includes a series of splined teeth (not shown) that engage similarly shaped portion on the shaft. The engagement of the motor 62 to the shaft 70 can be accomplished in a variety of other ways and the embodiment shown in FIGS. 28–29 is merely exemplary. For instance, the shaft 70 can formed so that a coupling is integral to the shaft 70 and the mating surfaces are directly formed on the drive shaft 82. Further, the drive shaft 70 can be pinned to the shaft 82 or to the polish clamp rod 84 at a variety of longitudinally positions corresponding to a desired location of the rotor relative to the stator. Further, a similar coupling can be used for one or more of the drive members, shown in FIG. 27.

The adjustment of the rotor relative to the shaft can be accomplished by a variety of mechanisms and procedures. For example, the adjustor 88, shown schematically in FIG. 28, can be a collar that surrounds the periphery of the shaft and can be tightened around the shaft to frictionally avoid slippage along the length of the collar, or a weldment on the shaft that protrudes from the shaft, and other devices and methods known to those in the art. Further, the adjustor can be a clamp that clamps the shaft at a certain height after the shaft is raised or lowered to a position. Other types of adjustors are possible and included within the meaning of the term "adjustor" herein that allows the rotor to be supported at and/or adjusted to a relative position with the stator.

FIG. 30 is a schematic cross sectional view of one example of an adjustor for a shaft. The tubular member 56 with a port 58 is disposed within the wellbore 50. A top 81 is formed with or coupled to the tubular member 56. The shaft 70 is disposed through the tubular member 56 and passes through at least a portion of an adjustor 88 coupled to the shaft. The shaft 70 can be sealed by a bearing and/or packing element 78 disposed in the adjustor 88. The element 78 could also be disposed in the tubular member 56, top 81, or other locations, so that fluid in the wellbore is restricted from passing therethrough. The adjustor 88 includes a first portion 94 and a second portion 96. The first portion 94 and the second portion 96 are adjustably engaged with each other at an engagement section 103, so that the first portion 94 of the adjustor can translate up and down in the second portion 96. For example, the engagement section 103 can include mating threads, so that rotating the first portion 94 and/or second portion 96 extends or contracts the adjustor. Other types of engagement include, for example, gears, sprockets, and linkages. A stop 98 is coupled to the shaft 70 and engages the adjustor 88 to translate the relative movement between the first and second portions of the adjustor 88 to the shaft 70. Alternatively, a coupling between a motor and the shaft, having a larger diameter than the shaft, could be used as the stop 98. It is believed that the weight of the shaft 70 and the PCP 20 will maintain the stop 98 in contact with the adjustor 88. However, if additional restriction is necessary, a corresponding stop (not shown) can be located below the first portion 94 to restrict the upward movement of the shaft 70 relative to the adjustor 88. A bearing 102 can be disposed between the stop 98 and the adjustor 88 to reduce frictional contact therebetween.

Figure 31:
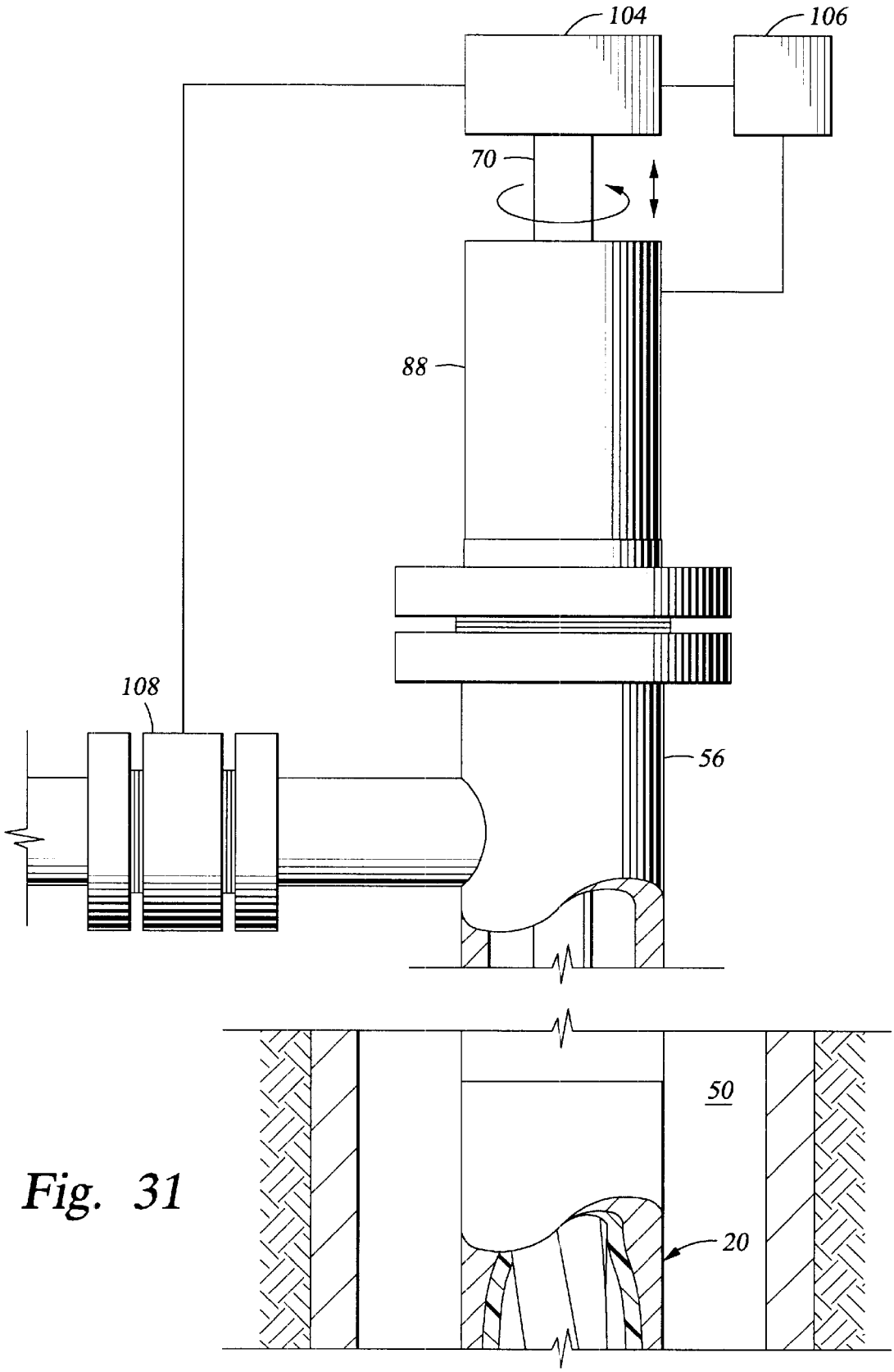
FIG. 31 is a schematic cross sectional view of a sensor coupled to an adjustor for the shaft.

FIG. 31 is a schematic cross sectional view of a sensor and a controller coupled to an adjustor 88 for the shaft 70. A tubular member 56 is disposed within a wellbore 50. An adjustor 88 is coupled to the shaft 70 and disposed above the tubular member 56. Alternatively, the adjustor can be disposed downhole within the wellbore 50 or within the tubular member 56. A sensor 104 is directly or indirectly coupled to the shaft 70 and senses the movement of the shaft 70. For example, the sensor 104 can measure the amount of torque on the shaft 70 created by the interaction of the rotor 26 rotating within the stator 22, described in reference to FIGS. 5–26. The sensor can measure other aspects, such as rotational speed, flow through a flow meter 108, shown in dotted lines, and other aspects of the PCP 20 in operation. The sensor generally would output some reading, such as electronically, audibly, visibly or by other means, so that an operator can make longitudinal adjustments of the engagement between the rotor and stator with the adjustor 88.

In some embodiments, a controller 106 may be coupled to the sensor 104 and the adjustor 88. The controller could receive output from the sensor 104 and create an output, using for example using a programmed sequence in a microprocessor and provide a signal to the actuator 88. The actuator 88 then could raise and lower or otherwise longitudinally adjust the position of the rotor and/or stator automatically. For example, the adjustor 88 could include a servomotor coupled to the shaft 70 to receive output from the controller 106 and longitudinally adjust the shaft 70. Further, the adjustor 88 could include hydraulic and/or pneumatic cylinders coupled to the shaft 70 that raise and lower or otherwise longitudinally adjust the rotor and/or stator. As another example, the adjustor 88 could include a gear motor or other gear arrangement that rotates a portion of the adjustor, such as the first portion 94 within the second portion 96 shown in FIG. 30, to translate or otherwise longitudinally adjust the shaft 70 up and down and, therefore, adjust the interface between the rotor and stator. While it is contemplated that the shaft 70 coupled to the rotor would generally be adjusted, it is to be understood that the present description includes adjusting the stator in addition to or in lieu of the rotor, for example, by raising and lowering the tubular member 56. The adjustor 88 may therefore be coupled to either the shaft 70 or the tubular member 56 or both to effect the relative longitudinal positions between the rotor 26 and the stator 22 in the PCP 20.

Figure 32:
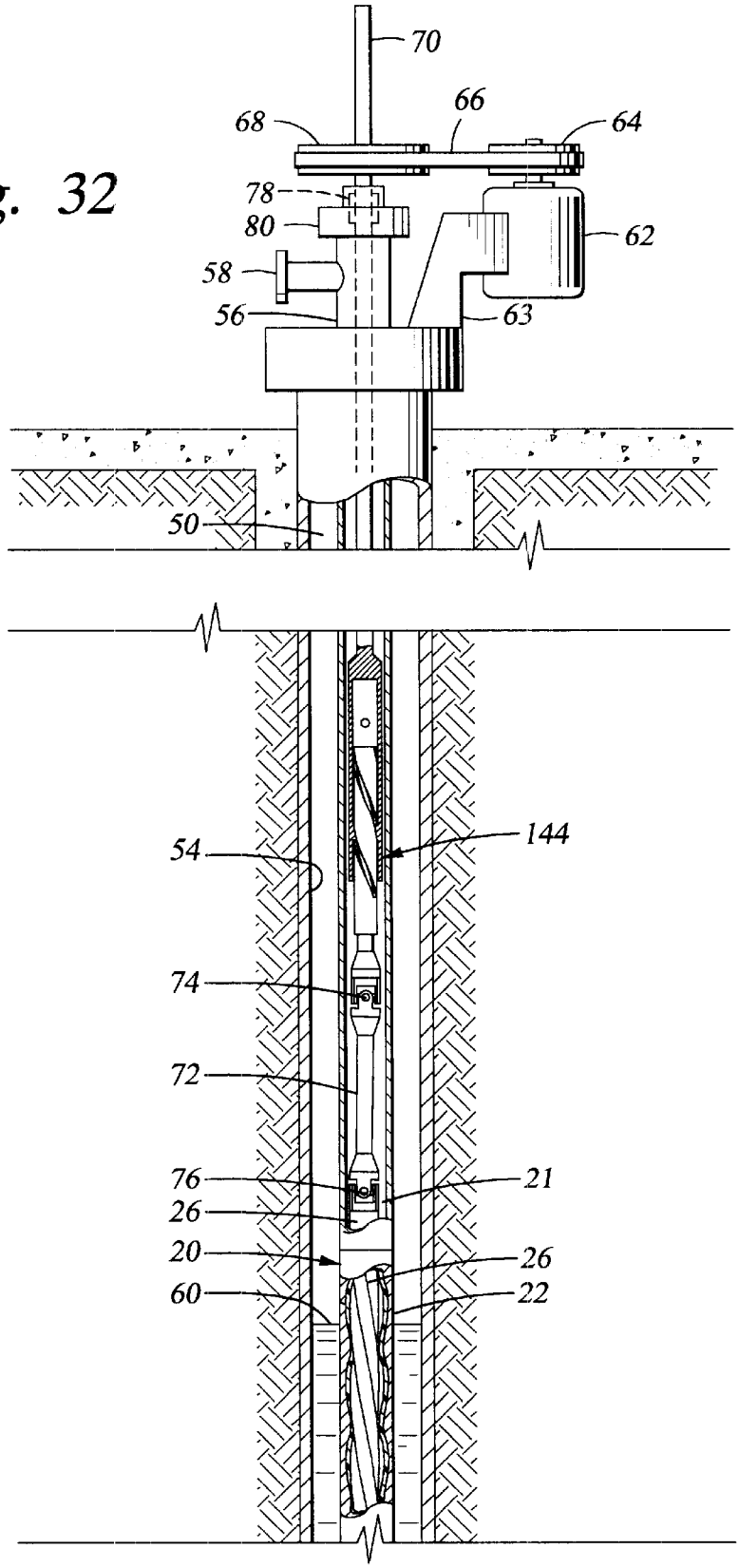
FIG. 32 is a schematic cross sectional view of an adjustable coupling coupled to a PCP.

FIG. 32 is a schematic cross sectional view of an adjustable coupling 144 as another example of an adjustor. The coupling 144 can be disposed downhole in the wellbore 50 and mechanically adjust the contact of the rotor 26 with the stator 22 in the PCP 20, by, for example, responding to excessive torque created between the rotor and stator. The coupling generally is disposed along the shaft 70, intermediate shaft 72 or rotor 26 to allow the rotor to adjust within the stator.

Figure 33:
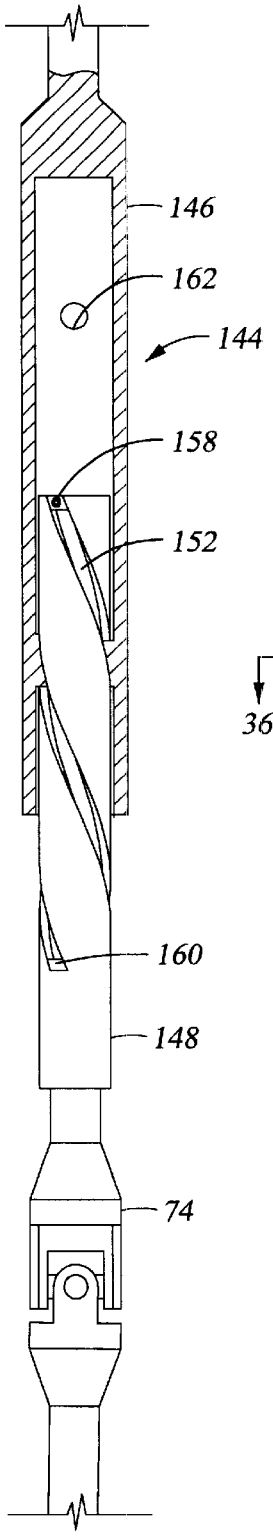
FIG. 33 is a schematic cross sectional detail of the adjustable coupling shown in FIG. 32 in a first position.
Figure 34:
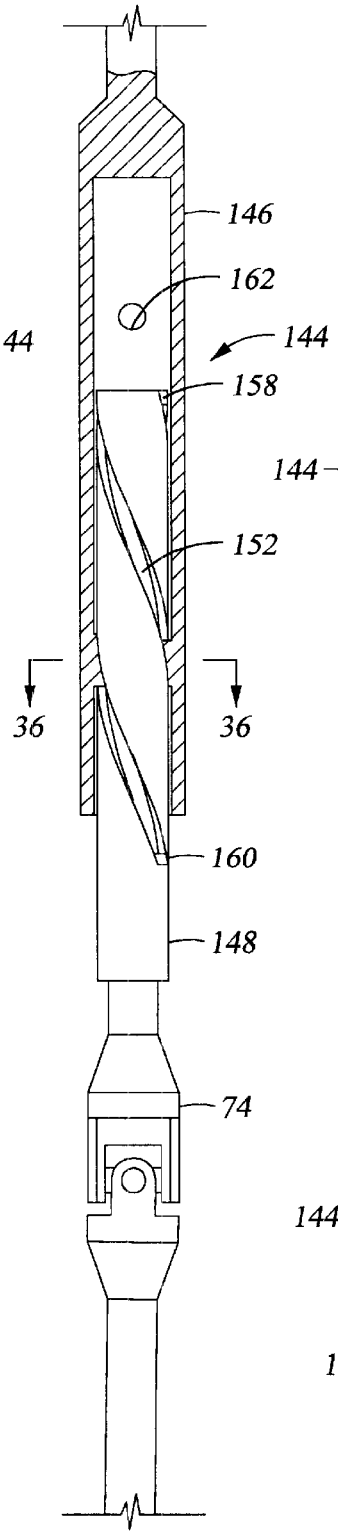
FIG. 34 is a schematic cross sectional detail of the adjustable coupling shown in FIG. 33 in a second position.

FIG. 33 is a schematic cross sectional detail of the adjustable coupling shown in FIG. 32 in a first position. FIG. 34 is a schematic cross sectional detail of the adjustable coupling shown in FIG. 33 in a second position and will be described jointly with FIG. 33. The coupling 144 includes a coupling first portion 146, such as a sleeve, and a coupling second portion 148, such as a shaft. The first portion 146 has one or more internal protrusions 150, such as pins, threads or other members, that engage threads 152 on the second portion 148. Alternatively, the protrusions 150 can be coupled to the second portion and the threads 152 coupled to the first portion. Other means for engaging the first portion and second portion can include a sprocket with ratcheting teeth, a conical shaft, gears and other engagement devices. A seal 154 can be disposed between the first portion and the second portion to seal the interior of the coupling from the ambient environment. A first stop 158 is disposed above the protrusion 150 and a second stop 160 is disposed below the protrusion to limit the travel of the second portion relative to the first portion. The threads 152 are formed on the second portion 148 at an angle Φ with respect to a longitudinal axis through the second portion.

Figure 35:
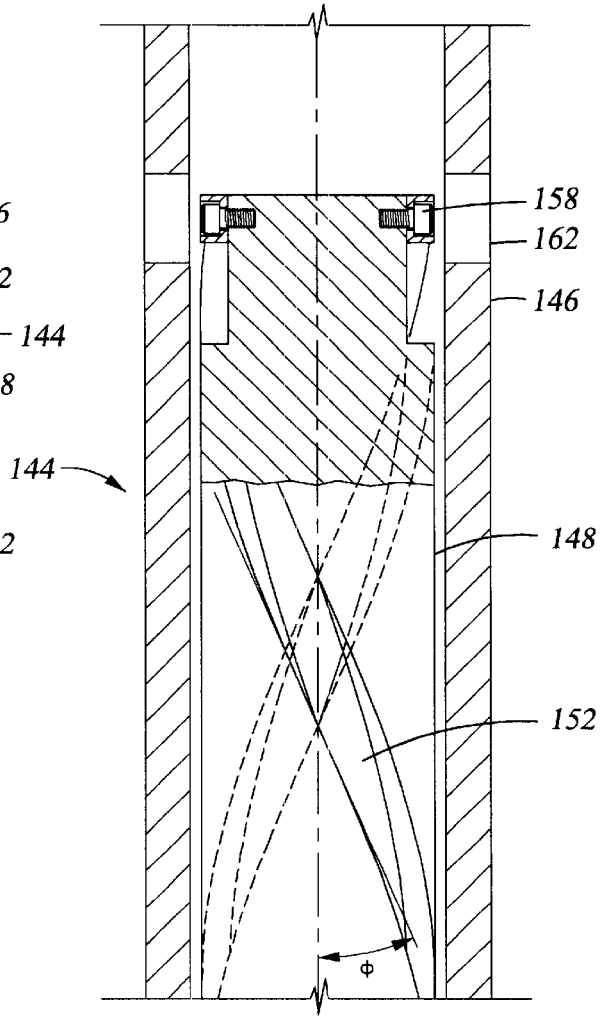
FIG. 35 is a schematic cross sectional detail of a stop for the adjustable coupling shown in FIGS. 33–34.

FIG. 35 is a schematic cross sectional detail of a stop for the adjustable coupling shown in FIGS. 33–34. The second portion 148 can include one or more stops 158 disposed at a location on the second portion to limit the extension of the second portion in the first portion 146. The stops can be permanently or removably coupled to the second portion and can include a threaded fastener 158. One or more access ports 162 can be formed in the first portion 146, so that the stops 158 can be coupled to the second portion. The ports 162 can be plugged or otherwise sealed after the stops are coupled to the second portion. Generally, the second portion 148 is inserted into the first portion 146 and the stops 158 coupled to the second portion after insertion.

Figure 36:
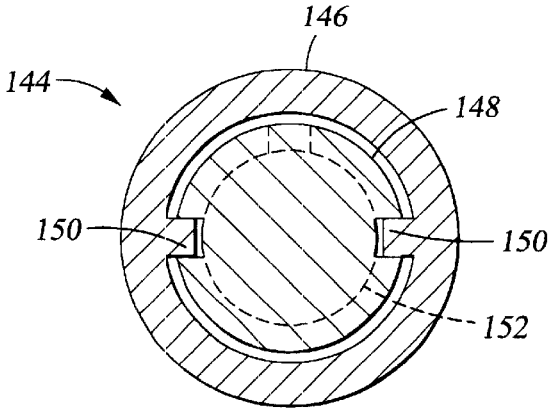
FIG. 36 is a schematic cross sectional view of the adjustable coupling shown in FIG. 35 at section 36.

FIG. 36 is a schematic cross sectional view of the adjustable coupling shown in FIG. 35 at section 36, as one example of the protrusions 150. One or more protrusions 150 extend from the first portion 146 and engage the second portion 148. The protrusions can be segmented or continuous, such as mating threads, or other engagement members to couple the first portion with the second portion.

Referring to FIGS. 32–36, in operation, the weight of the rotor 26, any tools and any portions of shaft coupled to the second portion pull the second portion down until either the protrusion 150 engages the second stop 160 or the rotor 26 engages the stator 22. As the motor 62 rotates the shaft 70 and, thus, the first portion 146, the first portion 146 transmits a torsional force to the second portion 148 and thence to the rotor 26 through the engagement between the protrusion 150 and threads 152. The force has a vertical component acting along the longitudinal axis and a horizontal component acting perpendicular to the longitudinal axis, where the relative magnitude of the force components depend on the angle Φ. The horizontal component of the resulting force acts to rotate the second portion and, thus, the rotor 26 is rotated within the stator 22. The vertical component of the torsional force and other forces, such as any force caused by interference engagement between the rotor and stator generally act to raise the second portion relative to the first portion. However, the weight of the second portion 148 and components disposed below the second portion generally pulls the components down. The Φ can be selected in combination with the torsional forces and weight of components and other forces, so that under normal operating conditions, the vertical forces are relatively balanced so that the rotor engages the stator at a first position. However, if resistance increases, for example, by the elastomeric member swelling, the torque required to rotate the rotor is increased and the vertical force component is also increased. The increased vertical component overcomes the weight and pulls the second portion 148, rotor 26 and other coupled components upward in the first portion 146 to a second portion to reestablish an equilibrium. Similarly, as torque reduces, the vertical component of the force is decreased and the second portion slides downward to reestablish the equilibrium between the weight, friction and torsional forces.

In some embodiments, a PCP is self-adjusting or self-compensating to maintain a desired interference fit. By "self-adjusting/compensating" is meant that at least part of the relative movement between the stator and the rotor is accomplished without the use of a surface drive assembly, such as the ones described above. Any of the embodiments described above can be configured as self-adjusting PCPs. However, in a preferred embodiment a self-adjusting PCP is a single lobe pump, whereas the foregoing description provides primarily for multi-lobe pumps. Accordingly, except where indicated otherwise, the following embodiments are assumed to be single lobe PCPs.

Figure 37C:
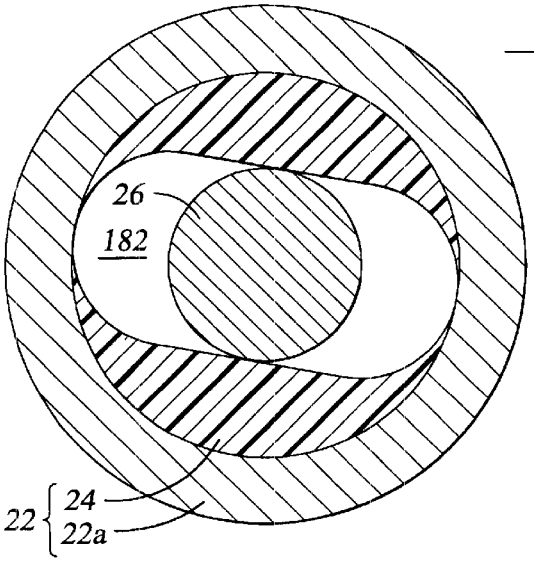
FIG. 37C is a schematic top cross sectional view of the PCP of FIG. 37A.

FIGS. 37A–B shows a side cross sectional view of a single-lobed, self-adjusting PCP 20 disposed in a well bore 50. FIG. 37C shows a top cross sectional view of the PCP 20. The well bore 50 is generally a subterranean opening formed in the earth 52, which includes dry land or subsea formations. Generally, the well bore 50 is lined with a casing 54 to stabilize the hole in the earth 52. The casing 54 is diametrically larger than a concentrically disposed production tubing 56. The production tubing 56 is suspended within the casing 54 and is secured at its upper end by any means known in the art. At its lower end, the production tubing 56 carries a PCP 20 which is secured to the inner surface of the casing 54 by an anchor 180. The anchor 180 operates to stabilize the PCP 20 and prevent relative axial movement between the casing 54 and the PCP 20.

The PCP 20 is shown schematically, but may embody any of the aspects described above. In general, the PCP 20 includes a stator 22 and a rotor 26 axially slidably disposed therein. The stator 22 includes a shell 22*a* lined on its inner surface with an elastomeric member 24. For simplicity, the elastomeric member 24 is uniform in thickness (i.e., the minor and major diameters are the same). However, it is understood that embodiments of the invention include elastomeric members of non-uniform thickness, such as the ones described above. The elastomeric member 24 defines a bore 182 with an increasing diameter from top to bottom. That is, a diameter of the bore 182 at an upper end is smaller than the diameter of the opening at a lower end. The bore 182 is shaped to accommodate the rotor 26 which has a conical shape, i.e., the diameter of the rotor 26 increases from top to bottom. Thus, the bore 182 and the rotor taper in the same direction.

As seen in FIG. 37B, the angle of the elasomeric member taper is defined as $\theta_1$ and the angle of the rotor taper is defined as $\theta_2$. Illustratively, $\theta_1$ and $\theta_2$ are between about 0.005 degrees and about 0.1 degrees depending on pump geometry and rod length. In one embodiment, $\theta_1$ and $\theta_2$ are equal along the length of the PCP 20. However, in other embodiments, $\theta_1$ and $\theta_2$ are different along the length of the PCP 20. In still other embodiments, $\theta_1$ and $\theta_2$ may be equal for some portion of the PCP 20 and different for another portion.

The angles of the taper are generally defined by an outer surface of the elasomeric member and the rotor. For example, the angles may be defined by the uppermost surfaces of the threads.

The rotor 26 is secured at its upper end to a rod string 70 which, in turn, is connected to a surface drive assembly 184. Illustrative drive assemblies are described above. The drive assembly is configured to provide at least rotation of the rod string 70 and the associated rotor 26 relative to the stator 22. In some cases, the drive assembly also provides axial movement of the rod string 70 and the rotor 26 relative to the stator 22. However, as will be described below, the relative axial movement between the rotor 26 and the stator 22 is achieved by the changing length of the rod string 70.

FIGS. 37A–B illustrate the PCP 20 in an environment in which the temperature is relatively low. Illustratively, the ambient temperature may be between about 15° C. and about 70° C. In such environment, the rod string 70 has a length L and the rotor 26 is in an initially raised position relative to the stator 22. The relative positioning between the stator 22 and the rotor 26 is selected to insure a desired interference fit along the length of the PCP 20. For the configuration shown in FIG. 37, a relatively raised position of the rotor 26 is desired in cooler temperature environments in which the elastomeric member 24 experiences little or no expansion.

Figure 38:
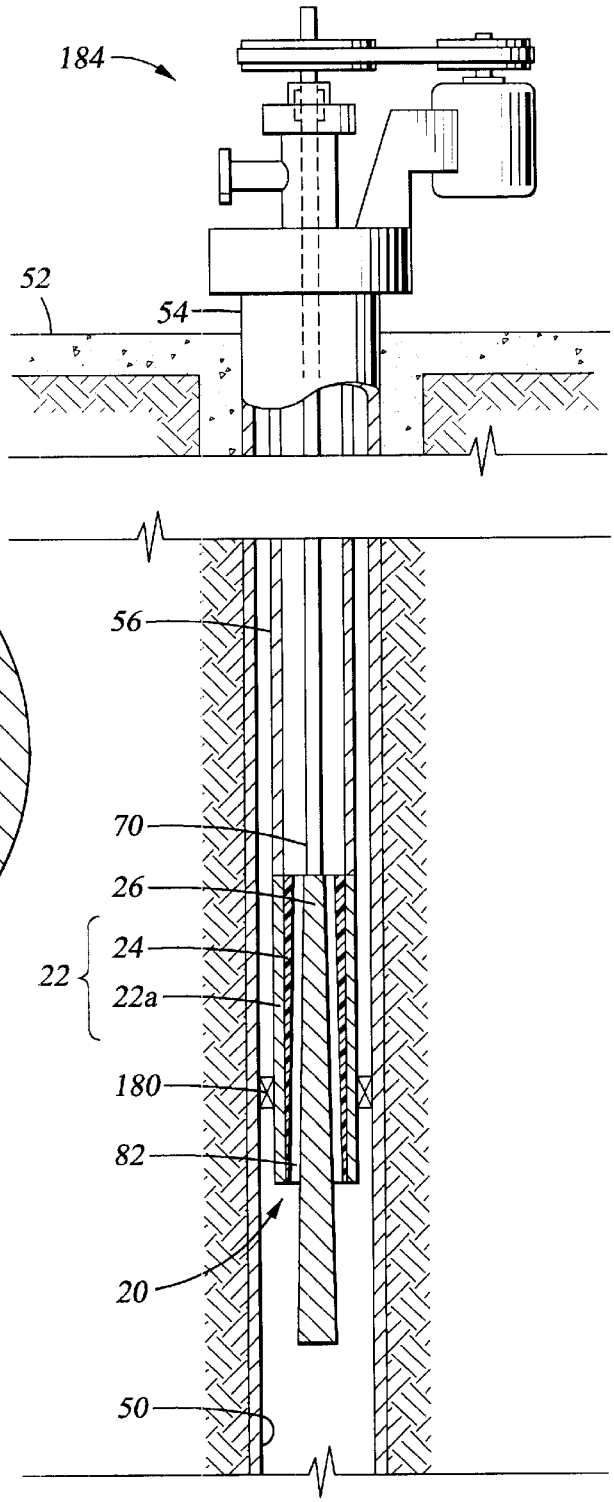
FIG. 38 is a schematic cross sectional view of the PCP shown in FIG. 37A in a second position.

FIG. 38 illustrates the PCP 20 in a relatively higher temperature environment. Illustratively, the ambient temperature may be between about 100° C. and about 250° C. With increasing temperature, the elastomeric member 24 has expanded to reduce the diameter of the opening along its length. In addition, the length of the rod string 70 is increased by an amount represented as $\Delta L$ due to thermal expansion. Assuming that the dimensions and position of the stator shell 22*a* and the production tubing 56 remain unchanged, the rotor 26 will experience a corresponding axial shift relative to the stator 22. In order to maintain a desired interference fit, the taper angle of the rotor 26 and elastomeric member 24 is selected according to the material properties of the rod string 70 (e.g., length and thermal expansion coefficient) and elastomeric member 24 (e.g., thickness and thermal expansion coefficient). Thus, where the material properties are known, the rotor 26 and elastomeric member 24 may be designed to accommodate relative axial movement over a range of temperatures. One method for determining a rotor taper angle ($\theta$) to maintain a desired interference fit is described below.

Figure 39:
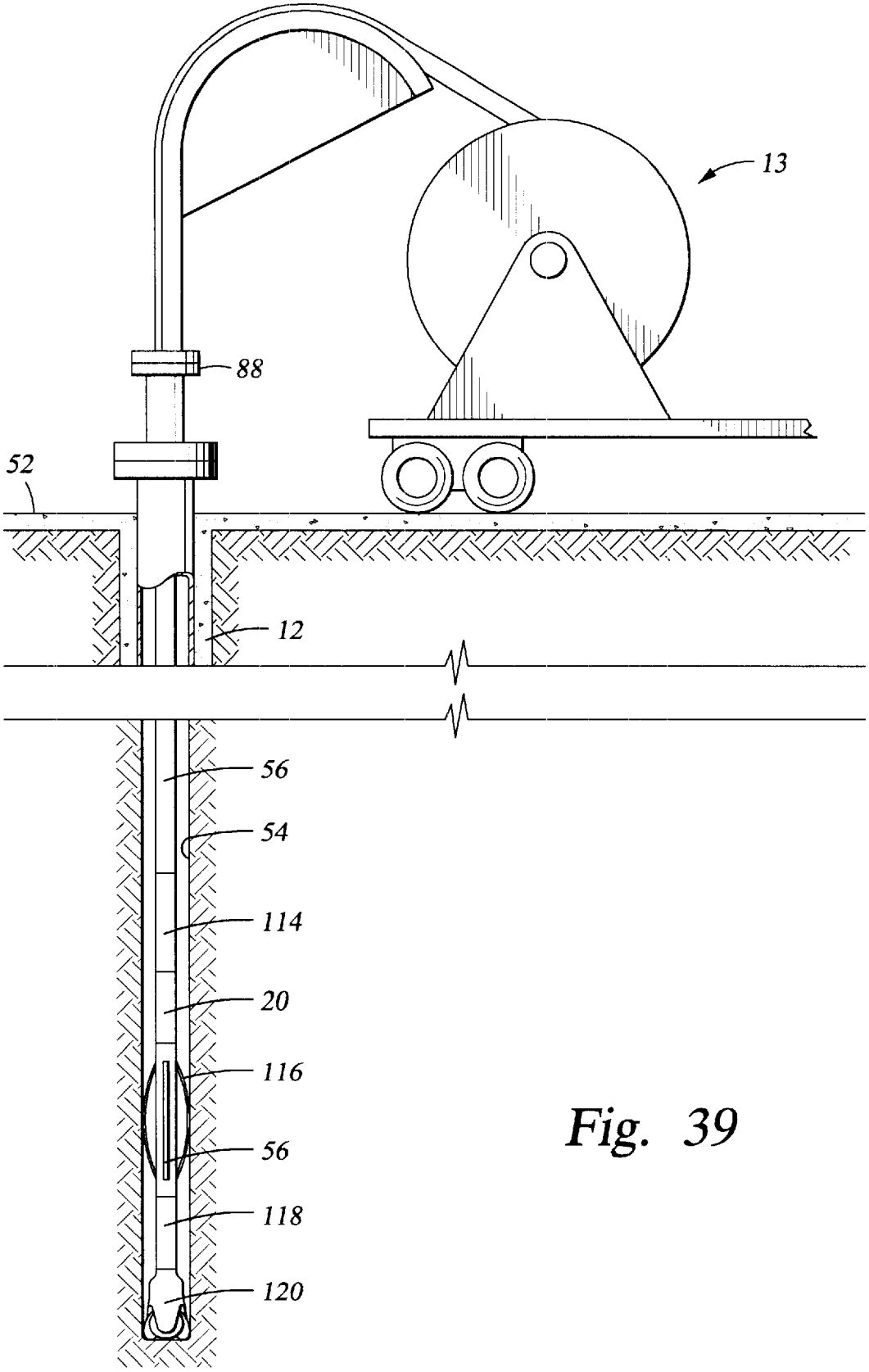
FIG. 39 is a schematic cross sectional view of a PCP used as a downhole motor.

In some cases, the PCP 20 is used as a motor to drive a tool, such as a drill bit. In such a case, an embodiment of the self-compensating PCP can be used to advantage. FIG. 39 is a schematic cross sectional view of the PCP 20 used as a downhole motor. The wellbore 50 includes a casing 54 disposed therein and a tubular member 56 disposed within the casing 54. The embodiment shown in FIG. 39 includes one exemplary set of components that can be used with a PCP 20 when the PCP is used as a downhole motor for various tools. A position measuring device 114, such as an MWD, is coupled to the tubular member 56. A PCP 20 is coupled to the position measuring device 114. A stabilizer sub 116 is coupled to the PCP 20 to maintain the alignment of the components within the wellbore 50. A cutting tool 120 is coupled to the assembly and includes, for example, a drill bit. If the cutting tool 120 is an end mill, the assembly may also include a cutting tool 118, such as a spacer mill, coupled between the stabilizer and the end mill. A drill bit is generally used to drill into a formation in the earth 52 and an end mill is generally used to cut an exit through a casing 54, shown in FIG. 27. An adjustor 88 can be coupled to either the rotor or stator as has been described above for adjusting the interface between the rotor and the stator. Fluid flowing down the tubular member 56, which may be coiled tubing, causes the rotor to rotate within the stator. The rotor rotates the cutting tool 120 or other device.

Figure 40:
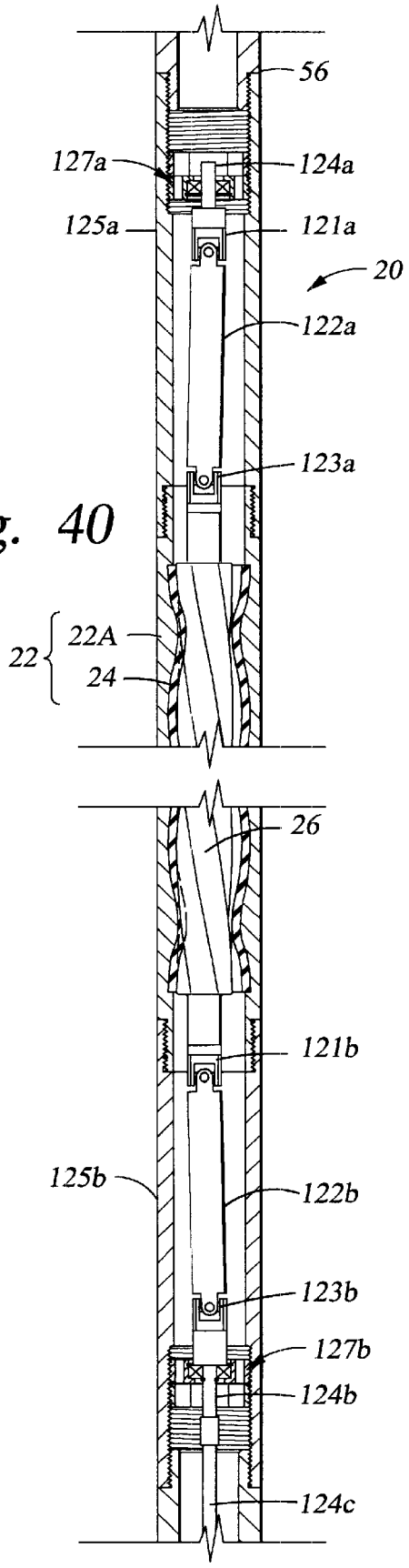
FIG. 40 is a schematic cross sectional view of one embodiment of an adjustable rotor for a PCP used as a motor.

FIG. 40 is a schematic cross sectional view of one embodiment of a self-compensating PCP 20 when the PCP used as a motor, such as in the embodiment shown in FIG. 39. A wellbore 50 includes a tubular member 56 disposed therein. The tubular member 56 carries a housing 125*a* at its lower end. The housing 125*a* and the tubular member 56 may be connected directly or indirectly through intermediate components. The PCP 20 is coupled at an upper end to housing 125*a* and at a lower end to housing 125*b*. The PCP 20 includes a tapered rotor 26 disposed within a tapered stator 22, which can include an elastomeric member 24. Embodiments of tapered PCPs have been described above.

At each end, the rotor 26 carries universal joints 121*a–b* and 123*a–b* with an intermediate shaft 122*a–b* disposed therebetween. The universal joints 121*a–b* couple the shafts 122*a–b* to a respective bearing assembly 127*a–b*. An upper bearing assembly 127*a* stabilizes a shaft 124*a* rotationally disposed therein. The upper bearing assembly 127*a* is adapted to provide the shaft 124*a* with a degree of axial tolerance selected to accommodate the expansion of the shafts 122*a–b*, the rotor 26 and other intermediate components that may expand/contract with temperature. In other embodiments, the shaft 122*a* is telescopic to achieve a similar tolerance.

The lower bearing assembly 127*b* is described with reference to FIG. 41. A detailed description of the upper bearing assembly 127*a* is not provided. However, it is understood that the description of the lower bearing assembly 127*b* is substantially applicable to the upper bearing assembly 127*a*.

Figure 41:
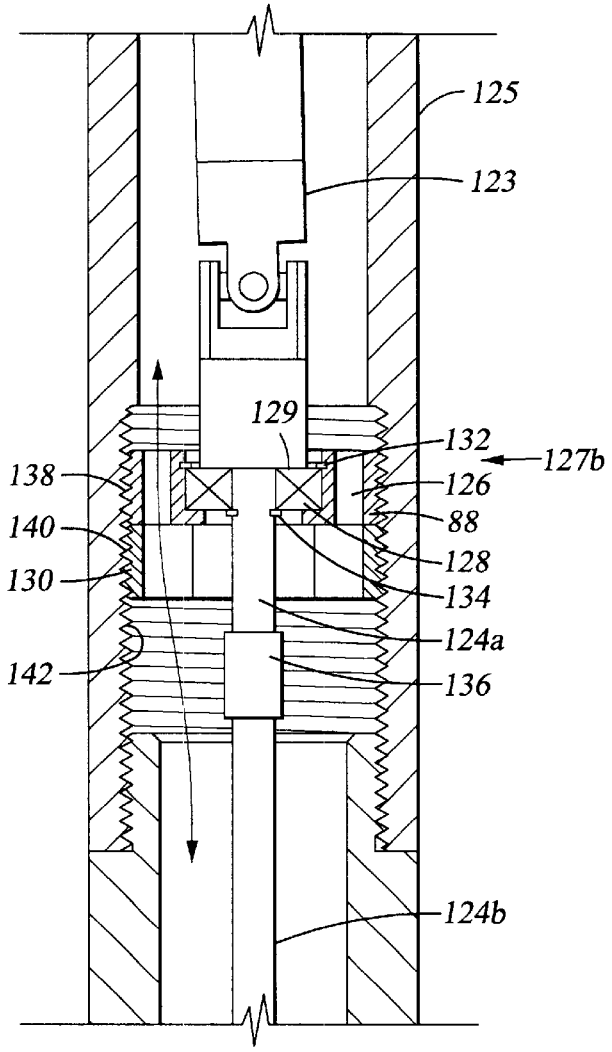
FIG. 41 is a schematic cross sectional detail of the embodiment shown in FIG. 40.

Referring now to FIG. 41, a drive shaft 124*b* is coupled to the universal joint 123*b* and can be formed integrally therewith. A drive shaft 124*c* can be coupled to the drive shaft 124*b* with a coupling 136 and provides an output drive for tools attached thereto. Optionally, an adjustor 88 is mounted within the PCP 20 or in an adjacent member to the PCP, such as the housing 125*b*. The adjustor 88 can threadably engage the housing with threads 138 formed on the adjustor to correspond to threads 140 formed on the housing. The shaft 124*b* can be disposed within the adjustor 88, so that the adjustor 88 can longitudinally move the shaft 124*b*, i.e., in an up and down direction in the figure, and components attached thereto to adjust the relative position of the rotor 26 with the stator 22. The rotor 26 can be adjusted relative to the stator 22 by rotating the adjustor 88 from a first position to a second position within the housing 125 and fastening the adjustor 88 in that longitudinal position with the fastening member 130.

Because fluid is generally used to actuate the PCP 20 as a motor, one or more ports 126 can be formed in the adjustor 88 through which the fluid can flow. A bearing 128 can be disposed between a supporting surface 129, for example, formed adjacent the shaft 124*b*, and the adjustor 88 to reduce friction as the rotor 26 and shaft 124*b* rotate. A fastening member 130 can be coupled to the housing 125*b*, for example, with threads 142, for holding the adjustor 88 in position. A retainer 132, such as a snap ring, can be disposed above the bearing 128 to hold the bearing in position with the adjustor 88. A retainer 134 can be disposed below the bearing 128 to hold the universal joint 123*b* and/or shaft 124*b* in position with the bearing 128.

In operation, fluid is flowed down the tubular member 56 to the PCP 20, through the interface between the rotor 26 and the stator 22, out the PCP 20 and through the port(s) 126. As the PCP 20 and the related components experience fluctuations in temperature, changes in the dimensions of the PCP and the components will occur. In particular, the shafts 122*a–b*, the housing 125*a–b* and the stator casing 22*a* may vary in their respective dimensions. Thus, the shaft 122*b* will expand axially with increasing temperature and drive the rotor 26 upward relative to the stator 22. The shaft 122*a* may also expand to counteract the upward force provided to the rotor 26 by the shaft 122*b*. However, as mentioned above, in one embodiment, the shaft 122*a* is axially slidably secured within the bearing assembly 127*a*, thereby allowing the shaft 122*a* to "float" to some degree. Accordingly, the lower shaft 122*b* provides a net upward force to the rotor 26. In addition, the elastomeric member 24 will expand to restrict the stator bore in which the rotor 26 is disposed. In order to maintain a desired interference fit, the materials of the shafts 122*a–b* and the housing 125*a–b* are selected according to their respective coefficients of expansion and matched to an appropriate taper angle of the rotor 26 and elastomeric member 24. In the case where the rotor 26 experiences a net movement upward relative to the stator 22, the input end (i.e., the upper end, closest to the universal joint 123*a*) of the PCP 20 will be larger relative to the output end. Such a configuration allows the rotor 26 to move upward into the larger diametric stator opening, thereby maintaining the desired fit as the elastomeric member 24 swells.

In general, each of the embodiments of the self-compensating PCPs relate the change in the diameter of the rotor to the change in the diameter of the stator at a given location of the stator. As used herein, reference to a change in the diameter of the rotor 26 refers to the diametric change of the rotor 26 at a given location of the stator 22. Reference to a change in the diameter of the stator 22 refers to the diametric change of the bore 182 at a given location of the stator 22. This relationship may be expressed as:

The value of the rotor diameter change (e.g., decrease due to translation)=the absolute value of the stator diameter change (e.g., decrease due to expansion) or $\Delta R=\Delta S$. (1)

Embodiments of the invention provide for expressions for the change in the diameter of both the rotor and the stator.

Rotor Diameter Change

For example, the change (decrease) in the rotor diameter can be expressed as the following equation:

$$\Delta R(\text{in})=2*\text{translation (in)}*\tan(\text{rotor taper angle, }\theta). \quad (2)$$

Further, in one embodiment, translation (in) is represented as:

Translation (in)=$\Delta T$(°C.)*rod string expansion coefficient*rod length (in). (3)

In a particular embodiment, the rod string expansion coefficient is 10.8×10-6 in/(in per °C.). Thus, after substitution, the equation (2) becomes:

$$\Delta R(\text{in})=2*\Delta T*10.8\times10\text{-}6\ \text{in/(in per °C.)}*\text{rod length (in)}*\tan(\theta). \quad (4)$$

Stator Diameter Change

For purposes of simplicity, some assumptions are made in describing the change in stator dimensions. First, the elastomer is assumed to be of uniform thickness and incompressible. Thus, while the elastomer may vary in thickness, a change in the thickness is assumed to be uniform throughout the elastomer. Second, the change in the stator shell diameter and rotor diameter due to temperature is negligable. Accordingly, a change in the inner diameter of the stator 22 is due only to the change in the thickness of the elastomer 24 and not a change in the diameter of the stator shell 22*a* or rotor 26. As such, an adjustment in the relative positions of the rotor and stator is made only in response to the changes in dimensions of the elastomer. Given these assumptions, the change in the stator diameter can be described as:

$$\Delta S = \text{elastomer thickness (in)} * 2 * \Delta T(^\circ\text{C.}) * \text{effective elastomer expansion coefficient (in/(in per }^\circ\text{C.))}. \quad (5)$$

In a particular embodiment, the effective elastomer expansion coefficient is equal to (3* linear elastomer expansion coefficient).

General Equation Relating Rotor and Stator Dimension Changes

The foregoing equations may be combined and reduced to yield a general equation relating rotor and stator dimension changes. Using equations (3) and (5), equation (1) can be restated as:

$$2 * \Delta T(^\circ\text{C.}) * \text{rod string expansion coefficient} * \text{rod length (in)} * \tan(\theta) = \text{elastomer thickness (in)} * 4 * \Delta T(^\circ\text{C.}) * \text{effective elastomer expansion coefficient (in/(in per }^\circ\text{C.))}. \quad (6)$$

Rearranging and simplifying, equation (6) produces:

$$\theta = \text{Tan}^{-1}[(\text{elastomer thickness (in)/rod length (in))} * (\text{elastomer expansion coefficient/rod expansion coefficient})] \quad (7)$$

Accordingly, for a known elastomer thickness, rod length, elastomer expansion coefficient and rod expansion coefficient the taper angle (θ) of the rotor (and elastomer) can be determined. These relationships may then be used to advantage to design a self-compensating pump.

EXAMPLE

An elastomeric member has an elastomer thickness of about 0.375 inches and an effective expansion coefficient of about $450\times10^{-6}$ in/(in per °C.). A rod string has a length of 3000 feet (36,000 inches) and an expansion coefficient of about $10.8\times10^{-6}$ in/(in per °C.). In this case, the taper angle of the rotor is:

$$\theta = \text{Tan}^{-1}[(0.375/36{,}000)\ (450\times10^{-6}/10.8\times10^{-6})] = 0.248^\circ$$

Application of the embodiments provided herein allows a pump to maintain a desired interference fit even when the pump is exposed to varying temperature conditions. In one embodiment, the interference fit is between about 0.015 and about 0.075. The dimensions and elastomer characteristics of a particular PCP are provided in Tables I and II below. Table I contains rod string information and Table II contains pump information at the top of the pump when aligned at ambient temperature. In this particular example, ambient temperature is about 25° C. For a particular tapered PCP having the specified rod string and pump characteristics (shown in Tables I and II), the optimal taper angle is 0.000435 (radians)/0.0248 (degrees). Stator diameter dimensions do not include the elastomer. Table III illustrates the dimensions of the tapered PCP of Table II with increasing temperature. Table III represents the dimensions at a given point in the stator for a number of different temperatures. As a result, the stator dimensions are changing (decreasing) due to thermal expansion of the elastomer. The rotor diameter is changing (increasing) due to rotor's axial downward movement. In comparison, Table IV illustrates the dimensions of a conventional PCP (having the dimensions of Table II, without the taper angle) with increasing temperature.

TABLE I

| ROD STRING INFORMATION | |
|---|---|
| Length (ft) | 2997.92 ft |
| Linear Expansion Coefficient | 10.8 × 10-6 in/in C |

TABLE II

| PUMP INFORMATION | |
|---|---|
| Stator Major Diameter | 2.300 inches |
| Stator Minor Diameter | 1.425 inches |
| Elastomer Thickness | 0.375 inches |
| Rotor Major Diameter | 1.888 inches |
| Rotor Minor Diameter | 2.450 inches |
| Elastomer Expansion Coefficient | 450 × 10-6 in/in C |
| Optimized Taper Angle | 0.000869 radians<br>0.0498 degrees |

TABLE III

| | | | Tapered PC Pump Configuration | | | | | |
|---|---|---|---|---|---|---|---|---|
| Temp (C.) | Rod String Stretch (inches) | Elastomer Expansion (%) | Stator Major (at Top) | Stator Minor (at Top) | Rotor Major (at Top) | Rotor Minor (at Top) | Major Interference | Minor Interference |
| 25 | 0.0 | 0.0 | 2.3000 | 1.4250 | 1.8875 | 1.45 | 0.025 | 0.025 |
| 50 | 9.7 | 1.1 | 2.2916 | 1.4166 | 1.8791 | 1.44156 | 0.025 | 0.025 |
| 75 | 19.4 | 2.3 | 2.2831 | 1.4081 | 1.8706 | 1.43313 | 0.025 | 0.025 |
| 100 | 29.1 | 3.4 | 2.2747 | 1.3997 | 1.8622 | 1.42469 | 0.025 | 0.025 |
| 125 | 38.9 | 4.5 | 2.2663 | 1.3913 | 1.8538 | 1.41625 | 0.025 | 0.025 |
| 150 | 48.6 | 5.6 | 2.2578 | 1.3828 | 1.8453 | 1.40781 | 0.025 | 0.025 |
| 175 | 58.3 | 6.7 | 2.2494 | 1.3744 | 1.8369 | 1.39938 | 0.025 | 0.025 |
| 200 | 68.0 | 7.9 | 2.2409 | 1.3659 | 1.8284 | 1.39094 | 0.025 | 0.025 |
| 225 | 77.7 | 9.0 | 2.2325 | 1.3575 | 1.8200 | 1.3825 | 0.025 | 0.025 |
| 250 | 87.4 | 10.1 | 2.2241 | 1.3491 | 1.8116 | 1.37406 | 0.025 | 0.025 |
| 275 | 97.1 | 11.3 | 2.2156 | 1.3406 | 1.8031 | 1.36563 | 0.025 | 0.025 |

TABLE IV

| | Rod | | Conventional PC Pump | | | | | |
|---|---|---|---|---|---|---|---|---|
| Temp (C.) | String Stretch (inches) | Elastomer Expansion (%) | Stator Major | Stator Minor | Rotor Major | Rotor Minor | Major Inter-ference | Minor Inter-ference |
| 25 | 0.0 | 0.0 | 2.3000 | 1.4250 | 1.888 | 1.450 | 0.025 | 0.025 |
| 50 | 9.7 | 1.1 | 2.2916 | 1.4166 | 1.888 | 1.450 | 0.033 | 0.033 |
| 75 | 19.4 | 2.3 | 2.2831 | 1.4081 | 1.888 | 1.450 | 0.042 | 0.042 |
| 100 | 29.1 | 3.4 | 2.2747 | 1.3997 | 1.888 | 1.450 | 0.050 | 0.050 |
| 125 | 38.9 | 4.5 | 2.2663 | 1.3913 | 1.888 | 1.450 | 0.059 | 0.059 |
| 150 | 48.6 | 5.6 | 2.2578 | 1.3828 | 1.888 | 1.450 | 0.067 | 0.067 |
| 175 | 58.3 | 6.7 | 2.2494 | 1.3744 | 1.888 | 1.450 | 0.076 | 0.076 |
| 200 | 68.0 | 7.9 | 2.2409 | 1.3659 | 1.888 | 1.450 | 0.084 | 0.084 |
| 225 | 77.7 | 9.0 | 2.2325 | 1.3575 | 1.888 | 1.450 | 0.093 | 0.093 |
| 250 | 87.4 | 10.1 | 2.2241 | 1.3491 | 1.888 | 1.450 | 0.101 | 0.101 |
| 275 | 97.1 | 11.3 | 2.2156 | 1.3406 | 1.888 | 1.450 | 0.109 | 0.109 |

Figure 42:
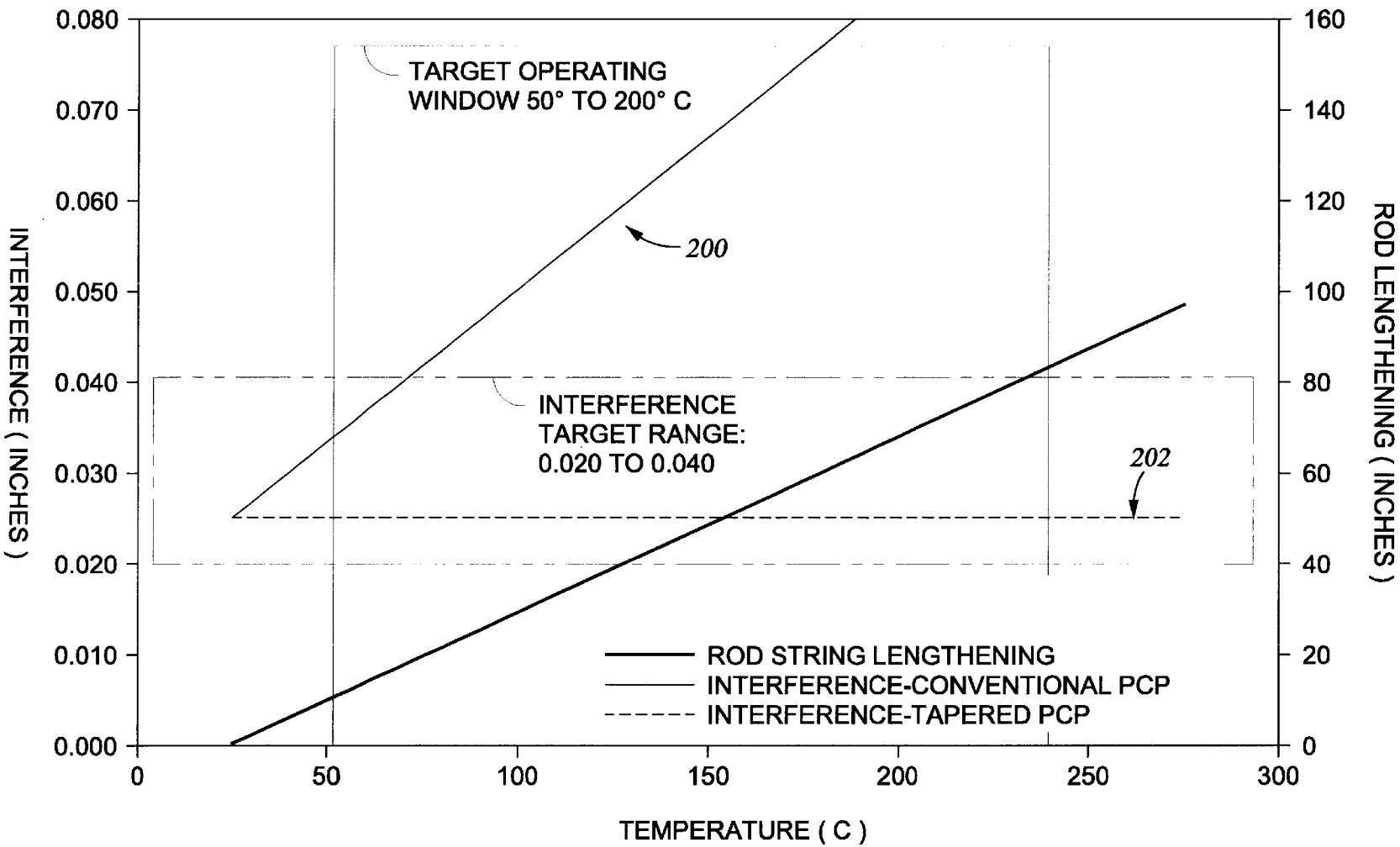
FIG. 42 is comparative graphical representation of an interference fit for a conventional PCP and a self-compensating PCP.

The effect on the interference fit for the illustrative PCP of Tables I and II is graphically illustrated in FIG. 42. FIG. 42 shows a graph in which a y-axis indicates the interference fit and the x-axis indicates temperature. A set of curves represents the interference fit of a conventional PCP and a self-compensating PCP of the invention. Specifically, a first curve 200 represents the interference fit of the conventional PCP (Table III). A second curve 202 represents the interference fit of the inventive PCP (Table IV). Only a single curve is shown for each PCP model because the elastomer is assumed to be of uniform thickness; therefore, the major and minor interferences are equal.

Illustratively, the target operating temperature is between about 75° C. and 200° C. and the interference target range is between about 0.020 and 0.040. The curve 200 has a positive slope and extends from an interference fit of about 0.025 at about 25° C. to an interference fit of about 0.080 at about 190° C. Thus, a substantial portion of the curve is located outside of the target range for the interference fit. In contrast, the curve 202 has no slope and thus maintains an interference fit of about 0.025 from a temperature of about 25° C. to about 200° C. Thus, the curve is well within the target range for the interference fit at the target operating temperatures.

While the forgoing is directed to the preferred embodiment of the present invention, other and further embodiments of the invention may be devised without departing from the basic scope thereof, and the scope thereof is determined by the claims that follow.

What is claimed is:

1. A progressive cavity pump having a inlet and an outlet, comprising:

a) a stator defining a bore tapered at an angle $\theta_1$ at least partially between the inlet and the outlet; and b) a rotor slidably disposed in the bore and tapered at an angle $\theta_2$ least partially between the inlet and the outlet; and c) a rod string connected to the rotor and having a length changing with temperature; wherein $\theta_1$ and $\theta_2$ are selected to maintain a predetermined fit between the stator and the rotor during the change in the length.

2. The pump of claim 1, wherein the stator and rotor are tapered in cooperation with each other.

3. The pump of claim 1, further comprising an adjustor coupled to the rod string.

4. The pump of claim 1, further comprising an adjustor coupled to the stator that changes a relative position of the rotor and the stator.

5. The pump of claim 1, wherein the stator and rotor are tapered diametrically.

6. The pump of claim 1, wherein the rotor and stator are larger at the input than the output of the pump.

7. The pump of claim 1, wherein the stator and rotor are tapered in thread height.

8. The pump of claim 1, further comprising an anchor disposed on an outer surface of the stator and adapted to secure the stator to a casing.

9. The pump of claim 1, wherein the length of the rod string is at first length as a first temperate and a second length at a second temperature.

10. The pump of claim 9, wherein the first length is less than the second length and the first temperature is less than the second temperature.

11. The pump of claim 1, wherein the predetermined fit is between about 0.015 and about 0.075.

12. The pump of claim 1, wherein $\theta_1$ and $\theta_2$ are substantially equal within a temperature range.

13. The pump of claim 1, wherein $\theta_1$ and $\theta_2$ are between about 0.005 degrees and about 0.1 degrees.

14. The pump of claim 1, wherein at least one of $\theta_1$ and $\theta_2$ is determined according to:

$$\theta = \mathrm{Tan}^{-1}[(\mathrm{Thickness_elastomer}/L)\ (TEC_\mathrm{elastomer}/TEC_\mathrm{rod\ string})],$$

where $\theta$ is one of $\theta_1$ and $\theta_2$, Thickness_elastomer is a thickness of an elastomeric member disposed between the stator and the rotor, L is the length of the rod string, TEC_elastomer is a thermal expansion coefficient of the elastomeric member, and TEC_rod string is a thermal expansion coefficient of the rod string.

15. The pump of claim 1, wherein an elastomeric member disposed between the stator and the rotor, the elastomeric member expanding with an increasing length of the rod string.

16. The pump of claim 15, wherein $\theta_1$ and $\theta_2$ are selected according to a degree of expansion of the elastomeric member.

17. A progressive cavity pump having a inlet and an outlet, comprising:

a) a stator carrying an elastomeric member on an inner surface, wherein the elastomeric member has a thickness and a thermal expansion coefficient and wherein a surface of the elastomeric member defines a bore having an increasing diameter along at least a portion of its length; and b) a rotor slidably disposed in the bore, wherein at least a portion of the rotor increases diametrically along its length and has an outer surface defining a taper angle θ, wherein the taper angle θ is selected to maintain a predetermined interference fit between the stator and the rotor during relative axial movement therebetween; and c) a rod string connected to the rotor and having a length that increases with an increasing temperature, whereby the rotor is axially moved relative to the stator when the stator is fixed in position;

wherein the taper angle θ is determined according to at least the thermal expansion coefficient of the elastomeric member, the thickness of the elastomeric member, the length of the rod string and a thermal expansion coefficient of the rod string.

18. The pump of claim 17, wherein the surface of the elastomeric member is inclined at the angle θ.

19. The pump of claim 17, wherein the stator and rotor are tapered in cooperation with each other.

20. The pump of claim 17, further comprising a motor coupled to the rod string to rotate the rod string.

21. The pump of claim 20, further comprising an adjustor coupled to the stator that changes a relative position of the rotor and the stator.

22. The pump of claim 17, wherein the stator and rotor are tapered diametrically.

23. The pump of claim 17, wherein the stator and rotor are tapered in thread height.

24. The pump of claim 17, further comprising an anchor disposed on an outer surface of the stator and adapted to secure the stator to a casing.

25. The pump of claim 17, wherein the length of the rod string is at first length as a first temperate and a second length at a second temperature.

26. The pump of claim 25, wherein the first length is less than the second length and the first temperature is less than the second temperature.

27. The pump of claim 17, wherein the interference fit is between about 0.015 inches and about 0.075 inches.

28. The pump of claim 17, wherein θ is determined according to:

$$\theta = \mathrm{Tan}^{-1}[(\mathrm{Thickness_elastomer}/L)\ (TEC_\mathrm{elastomer}/TEC_\mathrm{rod\ string})],$$

where Thickness_elastomer is the thickness of the elastomeric member, L is the length of the rod string, TEC_elastomer is the thermal expansion coefficient of the elastomeric member, and TEC_rod string is the thermal expansion coefficient of the rod string.

29. The pump of claim 17, wherein θ is between about 0.005 degrees and about 0.1 degrees.

30. A progressive cavity pump, comprising:

a) a stator defining a bore having a inlet and an outlet; and b) a rotor disposed in the bore and wherein the stator and the rotor define interfacing inclining surfaces adapted to move over one another and wherein the interfacing inclining surfaces are selected to define an interference fit that is maintained while the rotor is axially reciprocating within the bore in response to a change in an ambient temperature.

31. The pump of claim 30, further comprising a rod string connected to the rotor and having a length that increases in response to the change in the ambient temperature, whereby the rotor is axially moved relative to the stator.

32. The pump of claim 30, wherein the interference fit is between about 0.015 inches and about 0.075 inches.

33. The pump of claim 30, wherein the stator and rotor are tapered in cooperation with each other.

34. The pump of claim 30, wherein the stator and rotor are tapered diametrically.

35. The pump of claim 30, wherein the stator and rotor are tapered in thread height.

36. The pump of claim 30, further comprising an anchor disposed on an outer surface of the stator and adapted to secure the stator to a casing.

37. The pump of claim 30, wherein the interference fit is between about 0.015 inches and about 0.075 inches.

38. The pump of claim 30, wherein the interfacing inclining surfaces define an angle θ between about 0.005 degrees and about 0.1 degrees and wherein the angle θ is determined according to at least the thermal expansion coefficient of the elastomeric member, the thickness of the elastomeric member, the length of the rod string and a thermal expansion coefficient of the rod string.

39. The pump of claim 30, further comprising an elastomeric member disposed between the rotor and the stator and having a surface that defines one of the interfacing inclining surfaces, the surface having an angle θ determined according to at least a thermal expansion coefficient of the elastomeric member, a thickness of the elastomeric member, and a relative axial movement between the rotor and the stator in response to the change in the ambient temperature.

40. The pump of claim 39, further comprising a rod string connected to one end of the rotor and wherein angle θ is determined according to:

$$\theta = \mathrm{Tan}^{-1}[(\mathrm{Thickness_elastomer}/L)\ (TEC_\mathrm{elastomer}/TEC_\mathrm{rod\ string})],$$

where Thickness_elastomer is the thickness of the elastomeric member, L is a length of the rod string, TEC_elastomer is the thermal expansion coefficient of the elastomeric member, and TEC_rod string is a thermal expansion coefficient of the rod string.

41. The pump of claim 39, wherein θ is between about 0.005 degrees and about 0.1 degrees.

42. A method of adjusting a progressive cavity pump, comprising:

a) providing a rotor slidably disposed in an opening of a stator, wherein the stator and rotor comprise interfacing inclined surfaces; and b) axially moving the rotor and the stator relative to one another as a function of temperature; and c) maintaining a desired interference fit between the interfacing inclined surfaces while performing step b).

43. The method of claim 42, further comprising rotating the rotor relative to the stator.

44. The method of claim 42, wherein maintaining the desired interference fit comprises matching a geometry of the opening with relative axial movement between the stator and rotor.

45. The method of claim 42, wherein axially moving the rotor and the stator relative to one another comprises changing, with temperature, a length of a rod string connected to one end of the rotor.

* * * * *

UNITED STATES PATENT AND TRADEMARK OFFICE

CERTIFICATE OF CORRECTION

PATENT NO. : 6,457,958 B1
DATED : October 1, 2002
INVENTOR(S) : Lonnie Dunn

It is certified that error appears in the above-identified patent and that said Letters Patent is hereby corrected as shown below:

Column 20,
Line 31, please change "as a first temperate" to -- at a first temperature --.

Column 21,
Line 34, please change "as a first temperate" to -- at a first temperature --.

Signed and Sealed this

Eighteenth Day of February, 2003

JAMES E. ROGAN
*Director of the United States Patent and Trademark Office*